US011260661B2

(12) United States Patent
Watanabe et al.

(10) Patent No.: US 11,260,661 B2
(45) Date of Patent: Mar. 1, 2022

(54) LIQUID EJECTING HEAD AND LIQUID EJECTING APPARATUS

(71) Applicant: SEIKO EPSON CORPORATION, Tokyo (JP)

(72) Inventors: Yuki Watanabe, Matsumoto (JP); Akira Miyagishi, Matsumoto (JP); Akinori Taniuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/173,540

(22) Filed: Feb. 11, 2021

(65) Prior Publication Data

US 2021/0252861 A1 Aug. 19, 2021

(30) Foreign Application Priority Data

Feb. 14, 2020 (JP) ..... JP2020-023104

(51) Int. Cl.
*B41J 2/14* (2006.01)
*B41J 2/175* (2006.01)

(52) U.S. Cl.
CPC ..... *B41J 2/14201* (2013.01); *B41J 2/175* (2013.01); *B41J 2202/12* (2013.01)

(58) Field of Classification Search
CPC . B41J 2/175; B41J 2/18; B41J 2/14201; B41J 2202/12
See application file for complete search history.

(56) References Cited

U.S. PATENT DOCUMENTS

| | | | | |
|---|---|---|---|---|
| 9,278,525 | B2 * | 3/2016 | Miyagishi | B41J 2/14233 |
| 9,707,756 | B2 * | 7/2017 | Kusunoki | B41J 2/1433 |
| 10,252,528 | B2 * | 4/2019 | Kawakubo | B41J 2/1607 |
| 10,906,311 | B2 * | 2/2021 | Fukuzawa | B41J 2/1626 |
| 2013/0233939 | A1 | 9/2013 | Uezawa | |

FOREIGN PATENT DOCUMENTS

JP 2013-184372 A 9/2013

* cited by examiner

*Primary Examiner* — An H Do
(74) *Attorney, Agent, or Firm* — Workman Nydegger

(57) ABSTRACT

A width of the first nozzle channel in the first direction is larger than a width of the first communication channel in the second direction and a width of the first nozzle channel in a third direction intersecting the first direction and the second direction is smaller than a width of the first communication channel in the third direction.

20 Claims, 19 Drawing Sheets

LIQUID EJECTING HEAD AND LIQUID EJECTING APPARATUS

The present application is based on, and claims priority from JP Application Serial Number 2020-023104, filed Feb. 14, 2020, the disclosure of which is hereby incorporated by reference herein in its entirety.

BACKGROUND

1. Technical Field

The present disclosure relates to a liquid ejecting head and a liquid ejecting apparatus.

2. Related Art

Liquid ejecting heads that eject liquid such as ink from a plurality of nozzles have been proposed. For example, JP-A-2013-184372 discloses a liquid ejecting head that ejects liquid from a nozzle by causing a piezoelectric element to change the pressure of a liquid in a pressure chamber. The liquid ejecting head includes a plurality of nozzle channels for which nozzles are provided, and the plurality of nozzle channels are arrayed in a given direction. Additionally, the liquid ejecting head includes a plurality of communication channels that communicate with the nozzle channels, and the plurality of communication channels are also arrayed in a given direction.

In general liquid ejecting heads, it is desirable to increase both the width of a nozzle channel in a given direction and the width of a communication channel in a given direction. This is because the increase in width results in an increase in sectional area of the nozzle channel and an increase in sectional area of the communication channel, thus achieving a reduction in channel resistance. However, when nozzle channels or communication channels are densely arranged in a given direction particularly to enhance image quality, the increase in width makes it difficult to ensure a sufficient thickness of a partition between adjacent nozzle channels or between adjacent communication channels. In this case, vibration of one of the nozzle channels or one of the communication channels is transferred to another nozzle channel or another communication channel, and so-called structural crosstalk that causes a deterioration in ejection characteristics of a nozzle corresponding to another nozzle channel or another communication channel may significantly occur. Such significant structural crosstalk occurring not only between the nozzle channels but also between the communication channels may have a significant influence on ejection from the nozzle.

SUMMARY

To address the aforementioned problem, a liquid ejecting head according to a suitable aspect of the disclosure includes a first pressure chamber that extends in a first direction and applies pressure to a liquid, a second pressure chamber that extends in the first direction and applies pressure to the liquid, a first nozzle channel that extends in the first direction and includes a first nozzle for ejecting the liquid, a first communication channel that extends in a second direction intersecting the first direction and communicates with the first pressure chamber and the first nozzle channel, and a second communication channel that extends in the second direction and communicates with the second pressure chamber and the first nozzle channel, in which a width of the first nozzle channel in the first direction is larger than a width of the first communication channel in the second direction, and a width of the first nozzle channel in a third direction intersecting the first direction and the second direction is smaller than a width of the first communication channel in the third direction.

To cope with the aforementioned problem, a liquid ejecting head according to another suitable aspect of the disclosure includes a first pressure chamber that extends in a first direction and applies pressure to a liquid, a second pressure chamber that extends in the first direction and applies pressure to the liquid, a first nozzle channel that extends in the first direction and includes a first nozzle for ejecting the liquid, a first communication channel that extends in a second direction intersecting the first direction and communicates with the first pressure chamber and the first nozzle channel, and a second communication channel that extends in the second direction and communicates with the second pressure chamber and the first nozzle channel, in which a width of the first nozzle channel in the first direction is larger than a width of the first communication channel in the second direction, and a sectional area of the first nozzle channel as viewed in the first direction is smaller than a sectional area of the first communication channel as viewed in the second direction.

To cope with the aforementioned problem, a liquid ejecting head according to another suitable aspect of the disclosure includes a first pressure chamber that extends in a first direction and applies pressure to a liquid, a second pressure chamber that extends in the first direction and applies pressure to the liquid, a first nozzle channel that extends in the first direction and includes a first nozzle for ejecting the liquid, a first communication channel that extends in a second direction intersecting the first direction and communicates with the first pressure chamber and the first nozzle channel, and a second communication channel that extends in the second direction and communicates with the second pressure chamber and the first nozzle channel, in which a width of the first nozzle channel in the first direction is smaller than a width of the first communication channel in the second direction, and a width of the first nozzle channel in a third direction intersecting the first direction and the second direction is larger than a width of the first communication channel in the third direction.

To cope with the aforementioned problem, a liquid ejecting head according to another suitable aspect of the disclosure includes a first pressure chamber that extends in a first direction and applies pressure to a liquid, a second pressure chamber that extends in the first direction and applies pressure to the liquid, a first nozzle channel that extends in the first direction and includes a first nozzle for ejecting the liquid, a first communication channel that extends in a second direction intersecting the first direction and communicates with the first pressure chamber and the first nozzle channel, and a second communication channel that extends in the second direction and communicates with the second pressure chamber and the first nozzle channel, in which a width of the first nozzle channel in the first direction is smaller than a width of the first communication channel in the second direction, and a sectional area of the first nozzle channel as viewed in the first direction is larger than a sectional area of the first communication channel as viewed in the second direction.

DESCRIPTION OF EXEMPLARY EMBODIMENTS

A: First Embodiment

Figure 1:
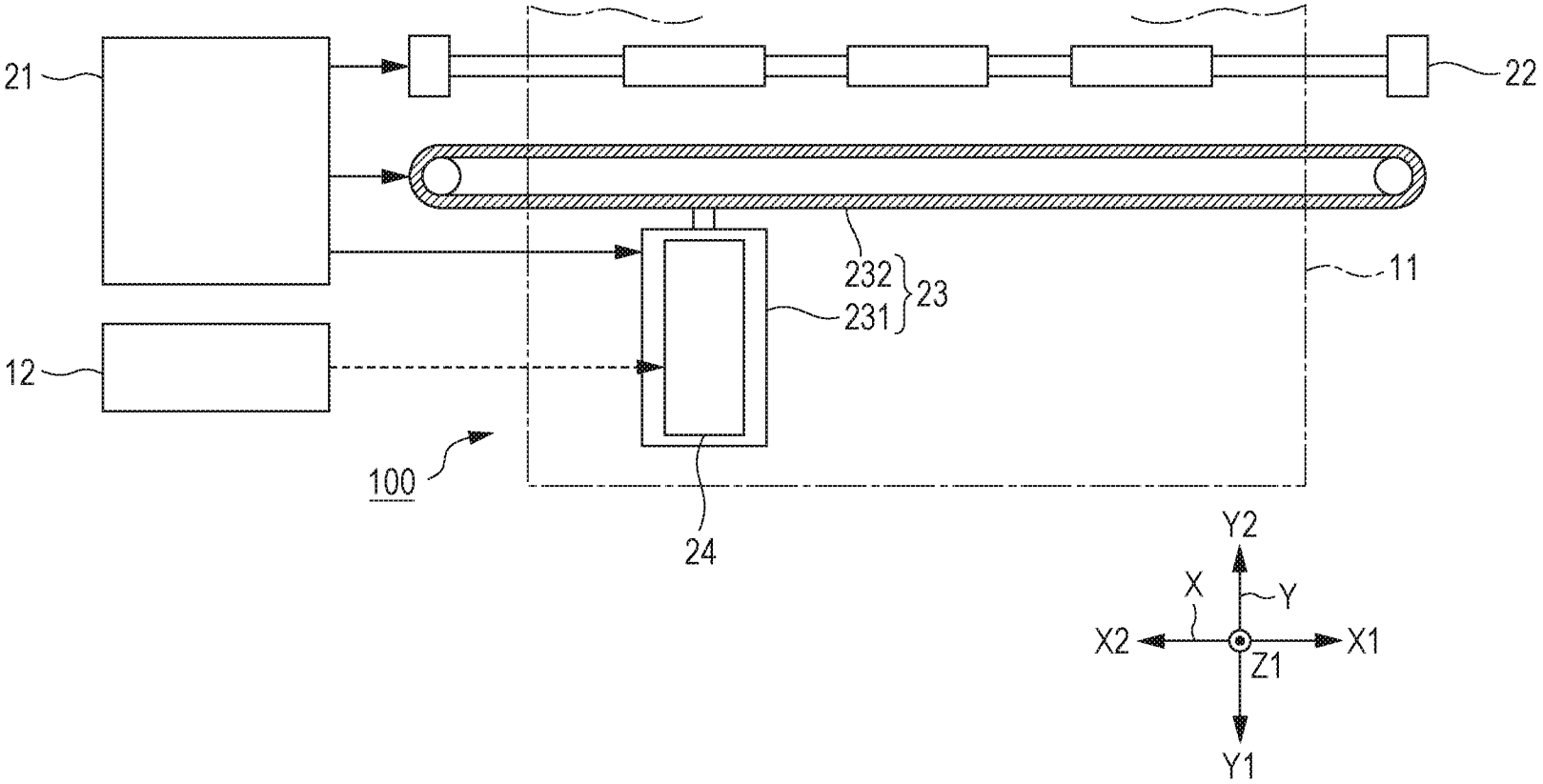
FIG. 1 is a schematic view illustrating an example of a partial configuration of a liquid ejecting apparatus according to a first embodiment.

In the following description, the X-axis, the Y-axis, and the Z-axis that cross each other are assumed. The X-axis, the Y-axis, and the Z-axis are common to all the drawings exemplified in the following description. As illustrated in FIG. 1, a direction along the X-axis as viewed from a certain point is expressed as direction X1, and a direction opposite to direction X1 is expressed as direction X2. Direction X1 corresponds to "a first direction". Similarly, directions opposite to each other along the Y-axis as viewed from a certain point are expressed as direction Y1 and direction Y2. Direction Y2 corresponds to "a third direction". Directions opposite to each other along the Z-axis as viewed from a certain point are expressed as direction Z1 and direction Z2. Direction Z1 corresponds to "a second direction". An X-Y plane that extends along the X-axis and the Y-axis corresponds to a horizontal plane. The Z-axis is an axis extending in the vertical direction, and direction Z2 corresponds to the down direction of the vertical direction.

FIG. 1 is a schematic view illustrating an example of a partial configuration of a liquid ejecting apparatus 100 according to the present embodiment. The liquid ejecting apparatus 100 is an ink jet printing apparatus that ejects droplets of liquid such as ink onto a medium 11. The medium 11 is, for example, a printing sheet. The medium 11 may be, for example, a printing object made from any material such as a resin film or fabric.

The liquid ejecting apparatus 100 includes a liquid container 12. The liquid container 12 accumulates ink. The liquid container 12 may be, for example, a cartridge detachably attachable to the liquid ejecting apparatus 100, a bag-like ink pack formed from a flexible film, or an ink tank that is able to be replenished with ink. Note that the liquid container 12 accumulates any type of ink.

As illustrated in FIG. 1, the liquid ejecting apparatus 100 includes a control unit 21, a transport mechanism 22, a moving mechanism 23, and a liquid ejecting head 24. The control unit 21 includes, for example, a processing circuit such as a central processing unit (CPU) or field programmable gate array (FPGA) and a storage circuit such as semiconductor memory and controls respective elements of the liquid ejecting apparatus 100, such as ejection operation of the liquid ejecting head 24. The control unit 21 is an example of "a control section".

The transport mechanism 22 transports the medium 11 in the Y-axis direction based on control of the control unit 21. The moving mechanism 23 causes the liquid ejecting head 24 to be reciprocated in the X-axis direction based on control of the control unit 21. The moving mechanism 23 includes a transport body 231 that is substantially box shaped and that houses the liquid ejecting head 24 and an endless transport belt 232 to which the transport body 231 is fixed. Note that the present embodiment can adopt a configuration in which a plurality of liquid ejecting heads 24 are mounted on the transport body 231 or a configuration in which the liquid container 12 is mounted on the transport body 231 together with the liquid ejecting head 24.

The liquid ejecting head 24 ejects the ink, which is supplied from the liquid container 12, from a plurality of nozzles onto the medium 11 based on control of the control unit 21. In conjunction with transport of the medium 11 by the transport mechanism 22 and reciprocation of the transport body 231, the liquid ejecting head 24 ejects the ink onto the medium 11 to thereby form an image on the surface of the medium 11.

Figure 2:
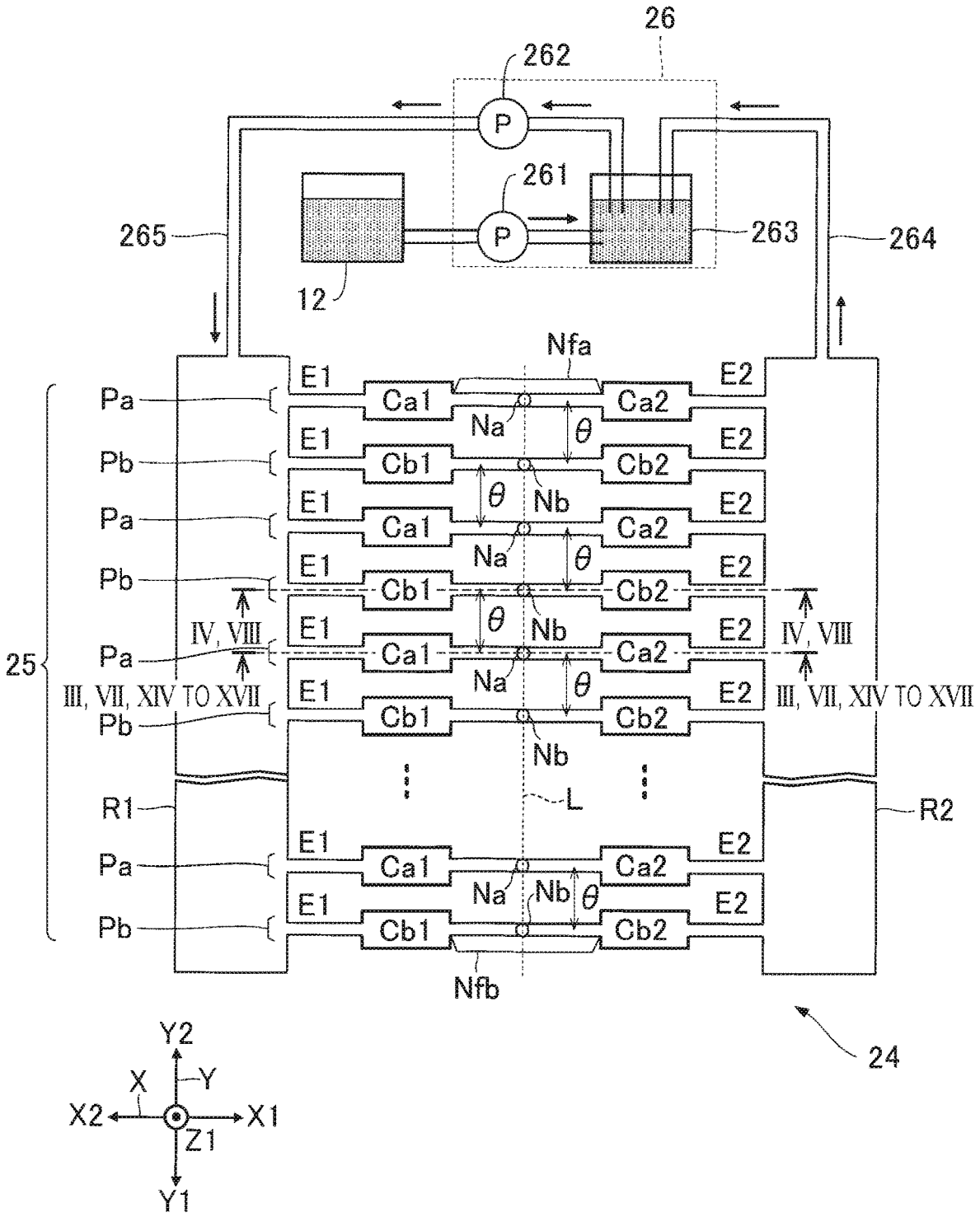
FIG. 2 is a schematic view illustrating a channel structure of a liquid ejecting head.

FIG. 2 is a schematic view illustrating a channel structure of the liquid ejecting head 24 when the liquid ejecting head 24 is viewed in the Z-axis direction. As illustrated in FIG. 2, a plurality of nozzles Na and a plurality of nozzles Nb are formed on the surface of the liquid ejecting head 24, which faces the medium 11. The plurality of nozzles Na and the plurality of nozzles Nb are arrayed in the Y-axis direction. The plurality of nozzles Na and the plurality of nozzles Nb eject the ink in the Z-axis direction. Thus, the Z-axis direction corresponds to a direction in which the ink is ejected from the plurality of nozzles Na and the plurality of nozzles Nb. A nozzle Na is an example of "a first nozzle", and a nozzle Nb is an example of "a second nozzle".

As illustrated in FIG. 2, the plurality of nozzles Na and the plurality of nozzles Nb are positioned on the same straight line and constitute a nozzle row L. The nozzle row L is a set of the plurality of nozzles Na and the plurality of nozzles Nb that are arrayed on the straight line in the Y-axis direction. As illustrated in FIG. 2, nozzles N including the nozzles Na and the nozzles Nb are arrayed at a pitch θ. The pitch θ is a distance between the center of a nozzle Na and the center of an adjacent nozzle Nb in the Y-axis direction.

In the following description, reference symbols of elements regarding the nozzle Na are suffixed with "a", and reference symbols of elements regarding the nozzle Nb are suffixed with "b". Note that, when there is no particular necessity to distinguish between the nozzle Na and the nozzle Nb, they are simply expressed as "nozzles N".

As illustrated in FIG. 2, the liquid ejecting head 24 includes an individual channel row 25. The individual channel row 25 is a set of a plurality of individual channels Pa and a plurality of individual channels Pb. The plurality of individual channels Pa extend in direction X1 and correspond to the nozzles Na that differ from each other. The plurality of individual channels Pa communicate with the nozzles Na. Similarly, the plurality of individual channels Pb extend in direction X1 and correspond to the nozzles Nb that differ from each other. The plurality of individual channels Pb communicate with the nozzles Nb. Note that, in the following description, when there is no particular necessity to distinguish between an individual channel Pa and an individual channel Pb, they are simply expressed as "individual channels P".

In the present embodiment, the individual channel Pa and the individual channel Pb that are adjacent to each other in the Y-axis direction have the same configuration. Detailed configurations of the individual channel Pa and the individual channel Pb will be described later. Note that, in the present application, the term "adjacent" when an element A and an element B are adjacent to each other means that at least a portion of the element A and at least a portion of the element B face each other in a case in which the element A and the element B are viewed in a specific direction. It is not necessary that the entire element A and the entire element B face each other, and a state where at least a portion of the element A and at least a portion of the element B face each other is considered as a state where the element A and the element B are "adjacent" to each other.

As illustrated in FIG. 2, the individual channel Pa includes a pressure chamber Ca1 and a pressure chamber Ca2. The pressure chamber Ca1 and the pressure chamber Ca2 of the individual channel Pa extend in direction X1. The pressure chamber Ca1 and the pressure chamber Ca2 accumulate the ink to be ejected from the nozzle Na that communicates with the individual channel Pa. When pressure in the pressure chamber Ca1 and the pressure chamber Ca2 changes, the ink is ejected from the nozzle Na. The pressure chamber Ca1 is an example of "a first pressure chamber", and the pressure chamber Ca2 is an example of "a second pressure chamber".

Similarly, the individual channel Pb includes a pressure chamber Cb1 and a pressure chamber Cb2. The pressure chamber Cb1 and the pressure chamber Cb2 of the individual channel Pb extend in direction X1. The pressure chamber Cb1 and the pressure chamber Cb2 accumulate the ink to be ejected from the nozzle Nb that communicates with the individual channel Pb. When pressure in the pressure chamber Cb1 and the pressure chamber Cb2 changes, the ink is ejected from the nozzle Nb. The pressure chamber Cb1 is an example of "a third pressure chamber", and the pressure chamber Cb2 is an example of "a fourth pressure chamber".

Note that, in the following description, when there is no particular necessity to distinguish between the pressure chamber Ca1, the pressure chamber Ca2, the pressure chamber Cb1, and the pressure chamber Cb2, they are simply expressed as "pressure chambers C".

As illustrated in FIG. 2, the liquid ejecting head 24 includes a first common liquid chamber R1 and a second common liquid chamber R2. Each of the first common liquid chamber R1 and the second common liquid chamber R2 extends in the Y-axis direction over an entire region in which the plurality of nozzles N are distributed. The individual channel row 25 and the plurality of nozzles N are positioned between the first common liquid chamber R1 and the second common liquid chamber R2 in plan view in the Z-axis direction. In the following description, the plan view in the Z-axis direction is simply referred to as "plan view".

The plurality of individual channels P communicate with the first common liquid chamber R1 in common. Specifically, an end E1 of each of the individual channels P in direction X2 is coupled to the first common liquid chamber R1. Similarly, the plurality of individual channels P communicate with the second common liquid chamber R2 in common. Specifically, an end E2 of each of the individual channels P in direction X1 is coupled to the second common liquid chamber R2. In the liquid ejecting head 24, the individual channels P enable the first common liquid chamber R1 and the second common liquid chamber R2 to communicate with each other. Thereby, the ink supplied from the first common liquid chamber R1 to the respective individual channels P is ejected from the nozzles N. Ink that is not ejected is discharged to the second common liquid chamber R2.

As illustrated in FIG. 2, the liquid ejecting head 24 includes a circulation mechanism 26. The circulation mechanism 26 is a mechanism that causes the ink discharged from the respective individual channels P to the second common liquid chamber R2 to return to the first common liquid chamber R1. The circulation mechanism 26 includes a first supply pump 261, a second supply pump 262, an accumulation container 263, a circulation channel 264, and a supply channel 265.

The first supply pump 261 is a pump that supplies the ink accumulated in the liquid container 12 to the accumulation container 263. The accumulation container 263 is a temporary storage tank that temporarily stores the ink supplied from the liquid container 12.

The circulation channel 264 is a channel that enables the second common liquid chamber R2 and the accumulation container 263 to communicate with each other and is used in common to discharge the ink from a discharge channel Ra2 and a discharge channel Rb2, which will be described later, via the second common liquid chamber R2. The circulation channel 264 and the second common liquid chamber R2 are examples of "a common discharge channel".

The ink accumulated in the liquid container 12 is supplied from the first supply pump 261 to the accumulation container 263, and the ink discharged from the respective individual channels P to the second common liquid chamber R2 is additionally supplied to the accumulation container 263 via the circulation channel 264.

The second supply pump 262 is a pump that discharges the ink accumulated in the accumulation container 263. The ink discharged from the second supply pump 262 is supplied to the first common liquid chamber R1 via the supply channel 265. The supply channel 265 is used in common to supply liquid to a supply channel Ra1 and a supply channel Rb1 described later. The supply channel 265 and the first common liquid chamber R1 are examples of "a common supply channel".

The plurality of individual channels P of the individual channel row 25 include the plurality of individual channels Pa and the plurality of individual channels Pb. Each of the plurality of individual channels Pa is an individual channel P that communicates with a corresponding nozzle Na of the nozzle row L. Similarly, each of the plurality of individual channels Pb is an individual channel P that communicates with a corresponding nozzle Nb of the nozzle row L. The individual channel Pa and the individual channel Pb are alternately arrayed in the Y-axis direction. Thereby, the individual channel Pa and the individual channel Pb are configured to be adjacent to each other in the Y-axis direction.

As illustrated in FIG. 2, the individual channel Pa includes a nozzle channel Nfa. The nozzle channel Nfa extends in direction X1 and is positioned between the pressure chamber Ca1 and the pressure chamber Ca2 as viewed in direction Z2 as illustrated in FIG. 2. The nozzle channel Nfa communicates with the pressure chamber Ca1 and the pressure chamber Ca2 and includes the nozzle Na that ejects the ink supplied from the pressure chamber Ca1. The nozzle channel Nfa is an example of "a first nozzle channel".

As illustrated in FIG. 2, the individual channel Pb includes a nozzle channel Nfb. The nozzle channel Nfb extends in direction X1 and is positioned between the pressure chamber Cb1 and the pressure chamber Cb2 as viewed in direction Z2 as illustrated in FIG. 2. The nozzle channel Nfb communicates with the pressure chamber Cb1 and the pressure chamber Cb2 and includes the nozzle Nb that ejects the ink supplied from the pressure chamber Cb1. The nozzle channel Nfb is an example of "a second nozzle channel".

The nozzle channel Nfa and the nozzle channel Nfb are alternately arrayed in the Y-axis direction. The nozzle channel Nfa and the nozzle channel Nfb are adjacent to each other with a given gap therebetween in the Y-axis direction.

In the liquid ejecting head 24 of the present embodiment, as illustrated in FIG. 2, a plurality of pressure chambers Ca1 corresponding to different nozzles Na of the nozzle row L and a plurality of pressure chambers Cb1 corresponding to different nozzles Nb of the nozzle row L are aligned on the straight line in the Y-axis direction. Similarly, a plurality of pressure chambers Ca2 corresponding to different nozzles Na of the nozzle row L and a plurality of pressure chambers Cb2 corresponding to different nozzles Nb of the nozzle row L are aligned on the straight line in the Y-axis direction. An array constituted by the plurality of pressure chambers Ca1 and the plurality of pressure chambers Cb1 and an array constituted by the plurality of pressure chambers Ca2 and the plurality of pressure chambers Cb2 are arranged side by side with a given gap therebetween in the X-axis direction. Here, the position of each of the pressure chambers Ca1 in the Y-axis direction and the position of each of the pressure chambers Ca2 in the Y-axis direction are the same but may differ from each other. Similarly, here, the position of each of the pressure chambers Cb1 in the Y-axis direction and the position of each of the pressure chambers Cb2 in the Y-axis direction are the same but may differ from each other.

Figure 3:
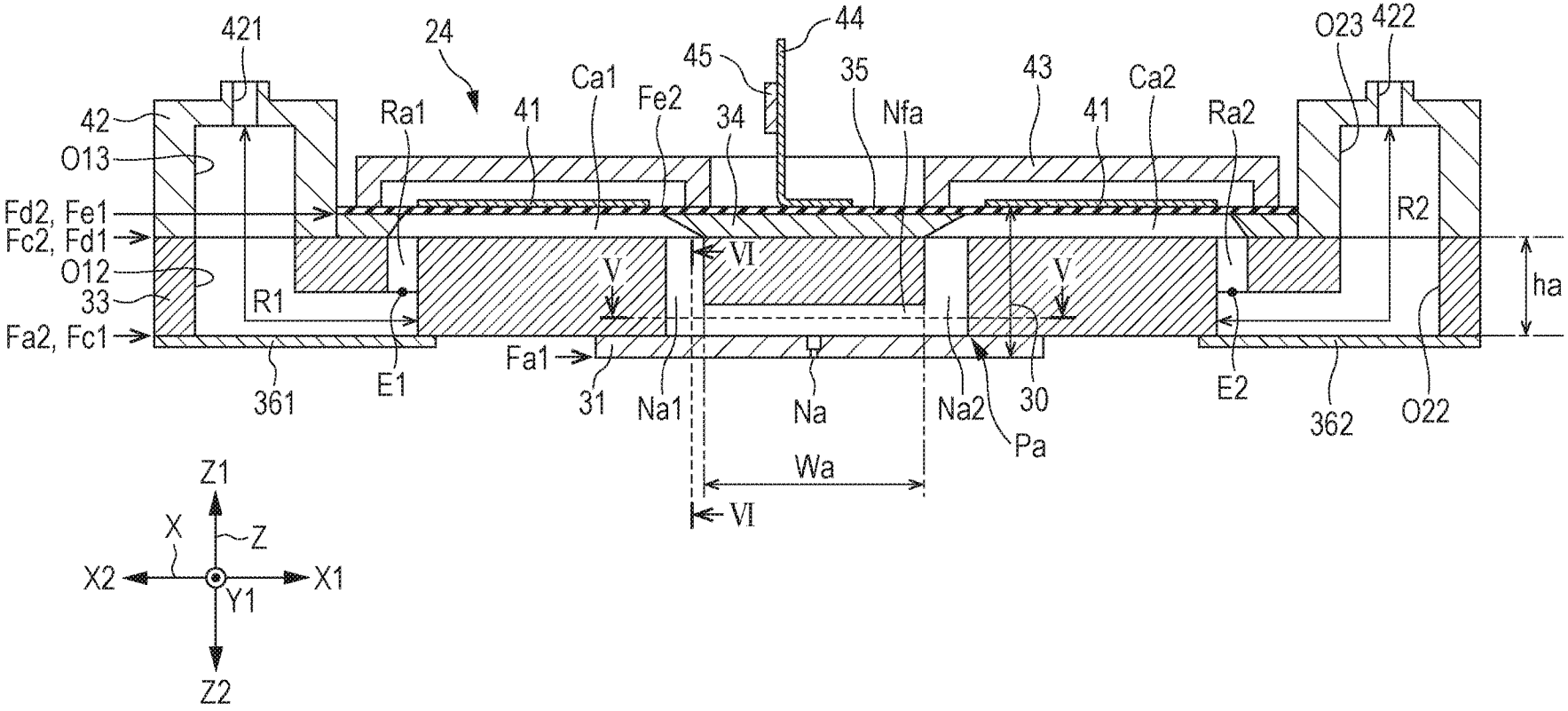
FIG. 3 is a sectional view along line III-III in FIG. 2.
Figure 4:
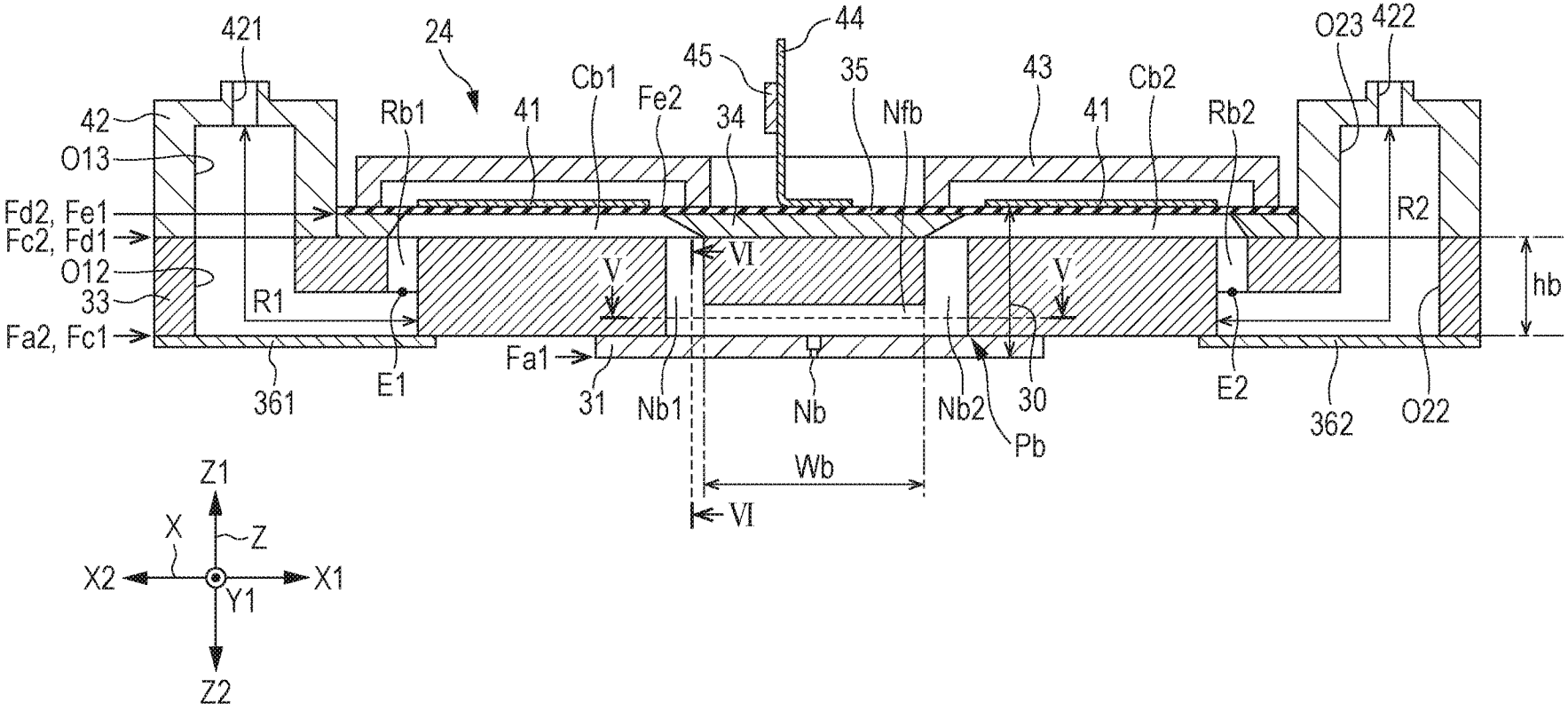
FIG. 4 is a sectional view along line IV-IV in FIG. 2.

Next, a detailed configuration of the liquid ejecting head 24 will be described. FIG. 3 is a sectional view along line III-III in FIG. 2, and FIG. 4 is a sectional view along line IV-IV in FIG. 2. FIG. 3 illustrates a sectional surface that passes through the individual channel Pa, and FIG. 4 illustrates a sectional surface that passes through the individual channel Pb.

As illustrated in FIGS. 3 and 4, the liquid ejecting head 24 includes a channel structure 30, a plurality of piezoelectric elements 41, a housing 42, a protection substrate 43, and a wiring substrate 44. The channel structure 30 is a structure in which a channel having the first common liquid chamber R1, the second common liquid chamber R2, the plurality of individual channels P, and the plurality of nozzles N is formed.

The channel structure 30 is a structure in which a nozzle substrate 31, a communication plate 33, a pressure chamber substrate 34, and a vibrating plate 35 are layered in order in direction Z1. The elements that constitute the channel structure 30 are each manufactured such that, for example, a silicon monocrystalline substrate is processed by using a general processing method for manufacturing a semiconductor.

The plurality of nozzles N are formed at the nozzle substrate 31. The plurality of nozzles N are through holes each of which has a cylindrical shape and enables the ink to pass therethrough. As illustrated in FIGS. 3 and 4, the nozzle substrate 31 is a plate member that has a surface Fa1 facing direction Z2 and a surface Fa2 facing direction Z1. The communication plate 33 is a plate member that has a surface Fc1 facing direction Z2 and a surface Fc2 facing direction Z1.

The elements that constitute the channel structure 30 are each formed into a rectangular shape, which is elongated in the Y-axis direction, and are bonded to each other, for example, with an adhesive. For example, the surface Fa2 of the nozzle substrate 31 is bonded to the surface Fc1 of the communication plate 33, and the surface Fc2 of the communication plate 33 is bonded to a surface Fd1 of the pressure chamber substrate 34. A surface Fd2 of the pressure chamber substrate 34 is bonded to a surface Fe1 of the vibrating plate 35.

A space O12 and a space O22 are formed in the communication plate 33. The space O12 and the space O22 are openings that are elongated in the Y-axis direction. A vibration absorber 361 that closes the space O12 and a vibration absorber 362 that closes the space O22 are disposed on the surface Fc1 of the communication plate 33. The vibration absorber 361 and the vibration absorber 362 are layer members formed of an elastic material. The communication plate 33 is an example of "a first communication plate".

The housing 42 is a case for accumulating the ink. The housing 42 is bonded to the surface Fc2 of the communication plate 33. A space O13 that communicates with the space O12 and a space O23 that communicates with the space O22 are formed in the housing 42. The space O13 and the space O23 are spaces that are elongated in the Y-axis direction. The space O12 and the space O13 communicate with each other to constitute the first common liquid chamber R1. Similarly, the space O22 and the space O23 communicate with each other to constitute the second common liquid chamber R2. The vibration absorber 361 constitutes a wall surface of the first common liquid chamber R1 and absorbs a change in the pressure of the ink in the first common liquid chamber R1. The vibration absorber 362 constitutes a wall surface of the second common liquid chamber R2 and absorbs a change in the pressure of the ink in the second common liquid chamber R2.

A supply port 421 and a discharge port 422 are formed in the housing 42. The supply port 421 is a pipeline, which communicates with the first common liquid chamber R1, and is coupled to the supply channel 265 of the circulation mechanism 26. The ink discharged from the second supply pump 262 to the supply channel 265 is supplied to the first common liquid chamber R1 via the supply port 421. On the other hand, the discharge port 422 is a pipeline, which communicates with the second common liquid chamber R2, and is coupled to the circulation channel 264 of the circulation mechanism 26. The ink in the second common liquid chamber R2 is supplied to the circulation channel 264 via the discharge port 422.

The pressure chamber Ca1, the pressure chamber Ca2, the pressure chamber Cb1, and the pressure chamber Cb2 are provided in the pressure chamber substrate 34. Each of the pressure chambers C is a void between the surface Fc2 of the communication plate 33 and the vibrating plate 35. Each of the pressure chambers C is formed so as to be elongated in the X-axis direction in plan view and extends in direction X1.

The vibrating plate 35 is a plate member capable of elastically vibrating. The vibrating plate 35 is constituted by, for example, stacking a first layer made of silicon oxide ($SiO_2$) and a second layer made of zirconium oxide ($ZrO_2$). Note that the vibrating plate 35 and the pressure chamber substrate 34 may be integrally formed by a plate member of a given thickness, from which a region corresponding to the pressure chamber C in the thickness direction is removed. Moreover, the vibrating plate 35 may be formed by a single layer.

The plurality of piezoelectric elements 41 corresponding to different pressure chambers C are disposed on a surface Fe2 of the vibrating plate 35. The piezoelectric elements 41 corresponding to the respective pressure chambers C overlap the pressure chambers C in plan view. Specifically, each of the piezoelectric elements 41 is constituted by stacking a first electrode and a second electrode that face each other with a piezoelectric layer formed between both the electrodes. The piezoelectric element 41 is an energy-generating element that generates energy and changes the pressure of the ink in a pressure chamber C by using the energy to thereby eject the ink in the pressure chamber C from the nozzle N. On receiving a driving signal, the piezoelectric element 41 causes the piezoelectric element 41 to deform and thereby causes the vibrating plate 35 to vibrate. When the vibrating plate 35 vibrates, the pressure chamber C expands and contracts. When the pressure chamber C expands and contracts, the pressure is applied from the pressure chamber C to the ink. Thereby, the ink is ejected from the nozzle N.

The protection substrate 43 is a plate member, which is disposed on the surface Fe2 of the vibrating plate 35, and protects the plurality of piezoelectric elements 41 and reinforces the mechanical strength of the vibrating plate 35. The plurality of piezoelectric elements 41 are housed between the protection substrate 43 and the vibrating plate 35. The wiring substrate 44 is mounted on the surface Fe2 of the vibrating plate 35. The wiring substrate 44 is a mounting component for electrically coupling the control unit 21 and the liquid ejecting head 24. For example, a flexible wiring substrate 44, such as a flexible printed circuit (FPC) or flexible flat cable (FFC), is suitably used. A drive circuit 45 for supplying a driving signal to each of the piezoelectric elements 41 is mounted on the wiring substrate 44.

Next, the configuration of the individual channel P will be described. In the following description, since the individual channel Pa and the individual channel Pb have the same configuration as described above, the configuration of the individual channel P will be described by describing mainly the configuration of the individual channel Pa as a representative example. Note that, by replacing the suffix "a" of the reference symbols of the respective elements that constitute the individual channel Pa with the suffix "b", the description for the individual channel Pa is similarly applicable to the respective elements that constitute the individual channel Pb. Here, the supply channel Rb1 is an example of "a second individual supply channel", and the discharge channel Rb2 is an example of "a second individual discharge channel". The nozzle channel Nfb is an example of "a second nozzle channel".

As illustrated in FIG. 3, the individual channel Pa has the supply channel Ra1, the pressure chamber Ca1, a first communication channel Na1, the nozzle channel Nfa, a second communication channel Na2, the pressure chamber Ca2, and the discharge channel Ra2. The individual channel Pa is a channel in which the aforementioned elements are integrally formed and coupled in this order.

The supply channel Ra1 is a space formed in the communication plate 33. Specifically, as illustrated in FIG. 3, the supply channel Ra1 extends, in the Z-axis direction, from the space O12 that constitutes the first common liquid chamber R1 to the surface Fc2 of the communication plate 33. An end of the supply channel Ra1, which is coupled to the space O12, is the end E1 of the individual channel Pa. The supply channel Ra1 is a channel that communicates with the pressure chamber Ca1 and that guides, to the pressure chamber Ca1, the ink supplied from the first common liquid chamber R1. The supply channel Ra1 is an example of "a first individual supply channel".

As illustrated in FIG. 3, the first communication channel Na1 is a space passing through the communication plate 33. The first communication channel Na1 is a channel that is elongated in the Z-axis direction. The first communication channel Na1 extends in direction Z1 and communicates with the pressure chamber Ca1 and the nozzle channel Nfa. The first communication channel Na1 is a channel that guides, to the nozzle channel Nfa, the ink pushed out from the pressure chamber Ca1.

The nozzle channel Nfa is a channel that is provided in the communication plate 33 and that extends in the X-axis direction. As illustrated in FIG. 3, the nozzle channel Nfa is positioned between the first communication channel Na1 and the second communication channel Na2 as viewed in the Z-axis direction. The nozzle channel Nfa communicates with the first communication channel Na1 and the second communication channel Na2 and includes the nozzle Na. The nozzle channel Nfa is a channel that guides, to the second communication channel Na2, the ink that is supplied from the first communication channel Na1 and that is not ejected from the nozzle Na.

As illustrated in FIG. 3, width Wa of the nozzle channel Nfa in direction X1 is larger than width ha of each of the first communication channel Na1 and the second communication channel Na2 in direction Z1. That is, the channel length of the nozzle channel Nfa is longer than the channel length of the first communication channel Na1 and the channel length of the second communication channel Na2. In the present embodiment, a ratio of width Wa to width ha, that is, Wa/ha, is desirably 1.5 or more and 4.0 or less.

As illustrated in FIG. 3, the second communication channel Na2 is a space that passes through the communication plate 33. The second communication channel Na2 is a channel that is elongated in the Z-axis direction. The second communication channel Na2 extends in direction Z1 and communicates with the pressure chamber Ca2 and the nozzle channel Nfa. The second communication channel Na2 is a channel that guides, to the pressure chamber Ca2, the ink supplied from the nozzle channel Nfa.

The discharge channel Ra2 is a space formed in the communication plate 33. Specifically, the discharge channel Ra2 extends, in the Z-axis direction, from the space O22 that constitutes the second common liquid chamber R2 to the surface Fc2 of the communication plate 33. An end of the discharge channel Ra2, which is coupled to the space O22, is the end E2 of the individual channel Pa. The discharge channel Ra2 is a channel that communicates with the pressure chamber Ca2 and that guides, to the second common liquid chamber R2, the ink pushed out from the pressure chamber Ca2. The discharge channel Ra2 is an example of "a first individual discharge channel".

According to the aforementioned configuration, during operation of the liquid ejecting apparatus 100, the liquid ejecting head 24 ejects the ink while causing the ink to circulate. Specifically, the ink from the liquid container 12 is supplied to the first common liquid chamber R1 via the supply channel 265. A drive section including the drive circuit 45 and the like then outputs a driving signal for driving a piezoelectric element to the piezoelectric element 41 on the pressure chamber Ca1 side and the piezoelectric element 41 on the pressure chamber Ca2 side and thereby drives the piezoelectric element 41 on the pressure chamber Ca1 side and the piezoelectric element 41 on the pressure chamber Ca2 side at the same time. Thereby, the ink supplied to the first common liquid chamber R1 is ejected from the nozzle Na. Moreover, of the ink supplied to the nozzle channel Nfa, the ink that is not ejected from the nozzle Na is supplied to the second common liquid chamber R2 via the discharge channel Ra2. The piezoelectric element 41 on the pressure chamber Ca1 side is an example of "a first energy-generating element", and the piezoelectric element 41 on the pressure chamber Ca2 side is an example of "a second energy-generating element". Note that the aforementioned operation regarding the individual channel Pa for causing the ink to circulate is similar to an operation regarding the individual channel Pb for causing the ink to circulate.

By causing the ink to circulate during ejection of the ink, the liquid ejecting head 24 of the present embodiment is able to suppress an increase in viscosity and precipitation of components of the ink near the nozzle Na and the nozzle Nb and prevent a deterioration in ejection characteristics of the ink. As a result, it is possible to keep the ejection characteristics of the ink substantially constant and improve ejection performance of the ink while suppressing a variation in the ejection characteristics. Note that the "ejection characteristics" described above are, for example, the ejection amount and ejection velocity of the ink. The same is applicable to the following description.

Figure 5:
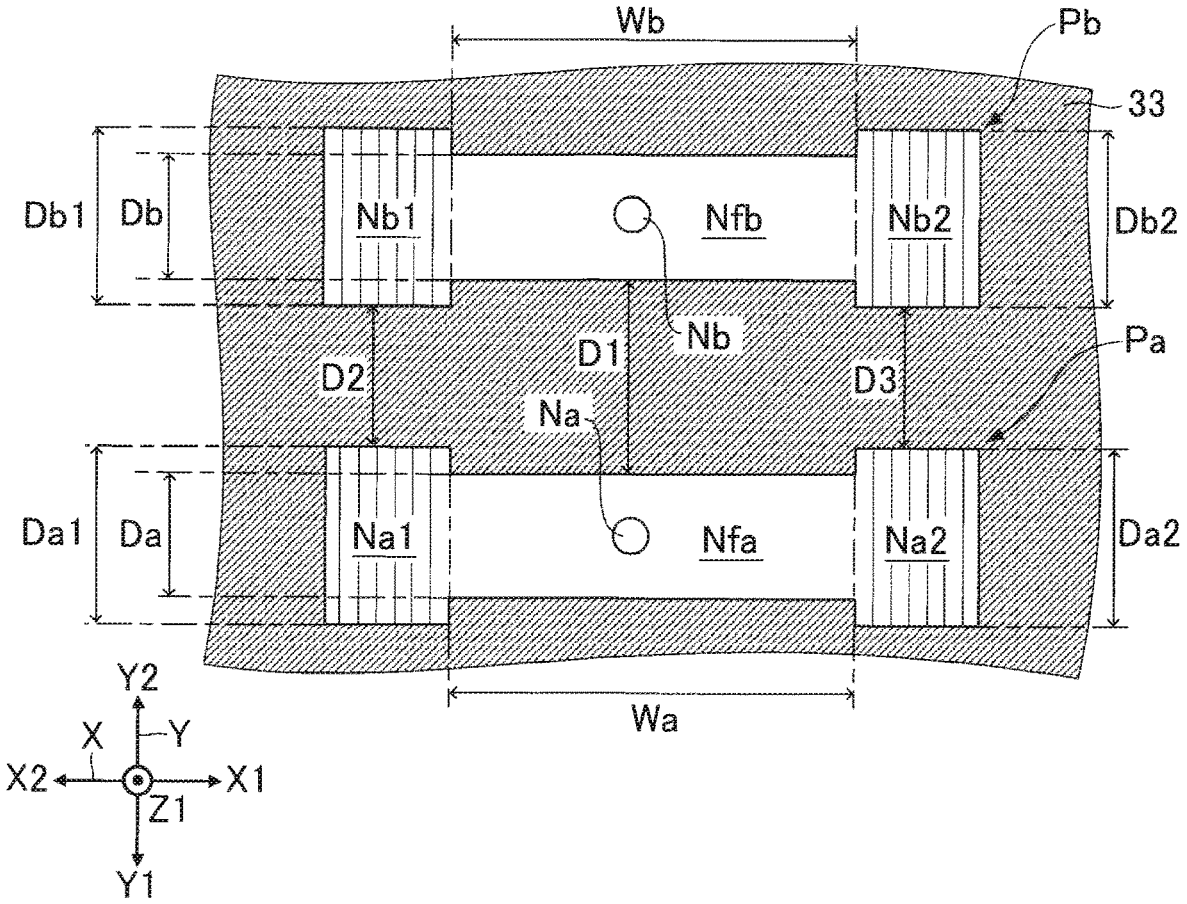
FIG. 5 is a partial sectional view along line V-V in FIGS. 3 and 4.
Figure 6:
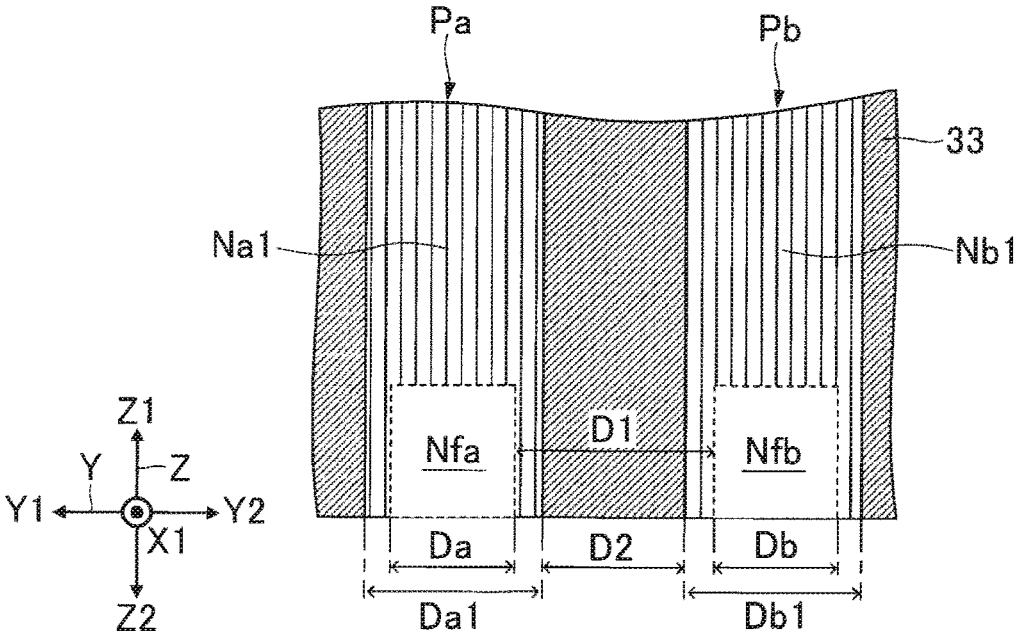
FIG. 6 is a partial sectional view along line VI-VI in FIGS. 3 and 4.

FIG. 5 is a partial sectional view along line V-V in FIGS. 3 and 4, and FIG. 6 is a partial sectional view along line VI-VI in FIGS. 3 and 4. In FIG. 6, illustration of the nozzle substrate 31 will be omitted.

Width Da of the nozzle channel Nfa in direction Y2 is smaller than width Da1 of the first communication channel Na1 in direction Y2 and smaller than width Da2 of the second communication channel Na2 in direction Y2. Similarly, width Db of the nozzle channel Nfb in direction Y2 is smaller than width Db1 of a third communication channel Nb1 in direction Y2 and smaller than width Db2 of a fourth communication channel Nb2 in direction Y2.

Moreover, as illustrated in FIG. 5, a distance between the nozzle channel Nfa and the nozzle channel Nfb in the Y-axis direction, that is, thickness D1 of a partition provided between the nozzle channel Nfa and the nozzle channel Nfb in the Y-axis direction is greater than thickness D2 of a partition provided between the first communication channel Na1 and the third communication channel Nb1 in the Y-axis direction and thickness D3 of a partition provided between the second communication channel Na2 and the fourth communication channel Nb2 in the Y-axis direction.

Further, in the present embodiment, the sectional area of the nozzle channel Nfa as viewed in the X-axis direction is smaller than the sectional area of the first communication channel Na1 and the sectional area of the second communication channel Na2, which are indicated by vertical lines in FIG. 5, as viewed in the Z-axis direction. Similarly, the sectional area of the nozzle channel Nfb as viewed in the X-axis direction is smaller than the sectional area of the third communication channel Nb1 and the sectional area of the fourth communication channel Nb2, which are indicated by vertical lines in FIG. 5, as viewed in the Z-axis direction.

The reason for adopting such a configuration will be described. Not that, for simplification, the following description will be given with reference to only the nozzle channel Nfa, the nozzle channel Nfb, the first communication channel Na1, and the third communication channel Nb1. Although no particular description will be given for the second communication channel Na2 and the fourth communication channel Nb2, regarding the relationship between the nozzle channel Nfa and the nozzle channel Nfb, the description for the first communication channel Na1 and the third communication channel Nb1 is similarly applicable to the second communication channel Na2 and the fourth communication channel Nb2.

As described above, in the first embodiment, width Wa of the nozzle channel Nfa and width Wb of the nozzle channel Nfb in direction X1 are larger than width ha of the first communication channel Na1 and width hb of the third communication channel Nb1 in direction Z1. Here, vibration caused by a change in internal pressure of one of the nozzle channels adjacent to another nozzle channel or one of the communication channels adjacent to another communication channel is transferred to the other nozzle channel or the other communication channel, and a phenomenon (hereinafter, referred to as "structural crosstalk") that causes a deterioration in ejection characteristics of a nozzle that communicates with the nozzle channel or the communication channel may occur. When the widths of the nozzle channels that are adjacent to each other and the widths of the communication channels that are adjacent to each other increase, the vibration is transferred for a longer time, and structural crosstalk has greater influence. That is, when it is assumed that the widths of the respective channels in the Y-axis direction are the same, structural crosstalk can occur significantly between the nozzle channel Nfa and the nozzle channel Nfb rather than between the first communication channel Na1 and the third communication channel Nb1.

In view of the foregoing, in the first embodiment, as illustrated in FIGS. 5 and 6, width Da of the nozzle channel Nfa and width Db of the nozzle channel Nfb in the Y-axis direction are set to relatively small values. This makes it possible to relatively increase thickness D1 of the partition between the nozzle channel Nfa and the nozzle channel Nfb, and even when vibration is generated in one of the nozzle channels, it is difficult for the vibration to be transferred to the other nozzle channel. Accordingly, it is possible to reduce structural crosstalk between the nozzle channel Nfa and the nozzle channel Nfb.

On the other hand, when the widths of the first communication channel Na1 and the third communication channel Nb1 in the Y-axis direction are reduced in the same manner as for the nozzle channel Nfa and the nozzle channel Nfb, the influence of structural crosstalk is able to be reduced. However, since width ha of the first communication channel Na1 and width hb of the third communication channel Nb1 in the Z-axis direction are small as described above, structural crosstalk does not initially become significant. When the widths of the first communication channel Na1 and the third communication channel Nb1 in the Y-axis direction are reduced, both the channel sectional area of the first communication channel Na1 and the channel sectional area of the third communication channel Nb1 are reduced, and channel resistance of all the channels corresponding to the nozzle Na increases. The same is applicable to the nozzle Nb. Thus, relatively increasing width Da1 of the first communication channel Na1 and width Db1 of the third communication channel Nb1 in the Y-axis direction suppresses an increase in channel resistance.

As described above, according to the first embodiment, it is possible to reduce structural crosstalk between the nozzle channels while suppressing an increase in channel resistance of each of the communication channels.

B: Second Embodiment

Figure 7:
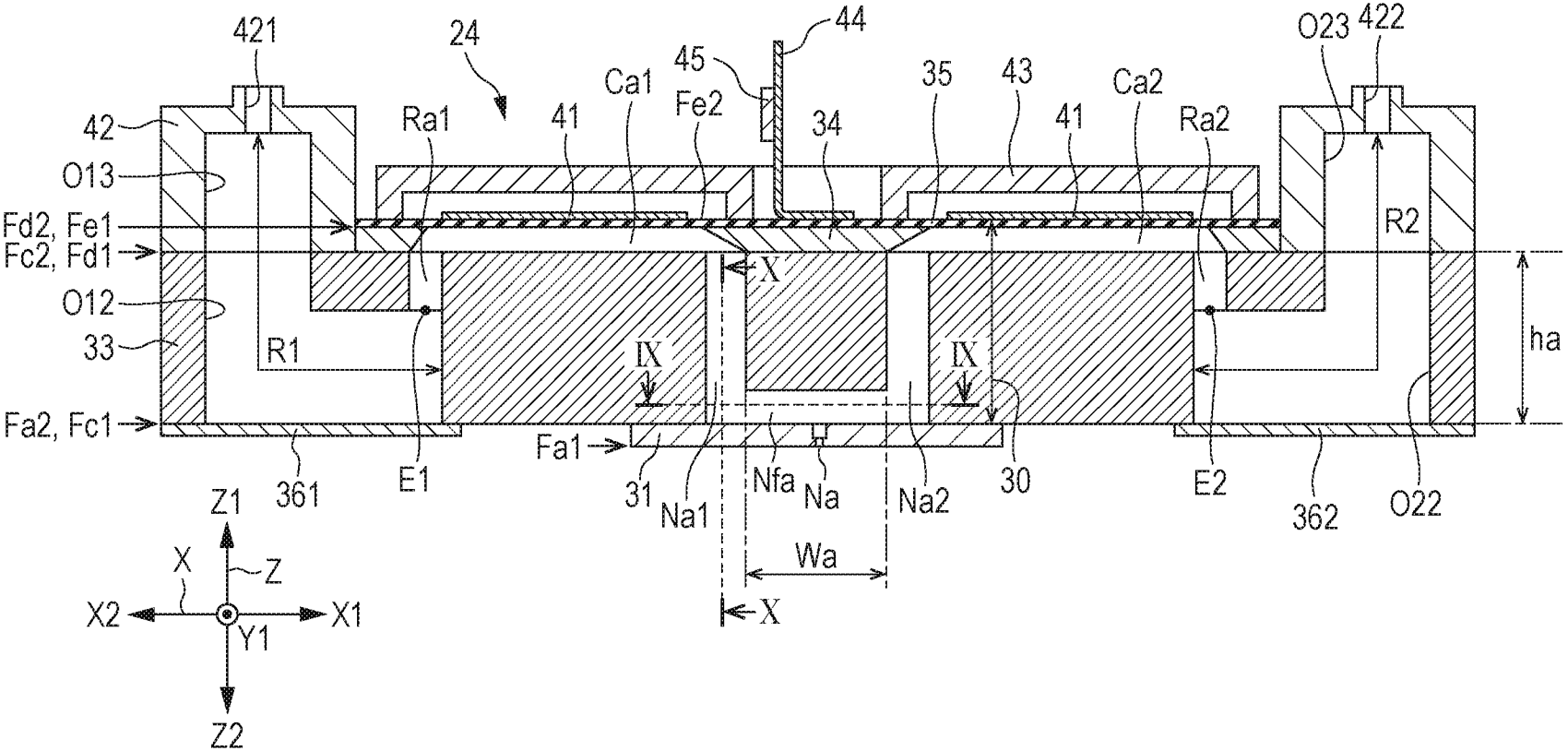
FIG. 7 is a sectional view along line VII-VII in FIG. 2 according to a second embodiment.
Figure 8:
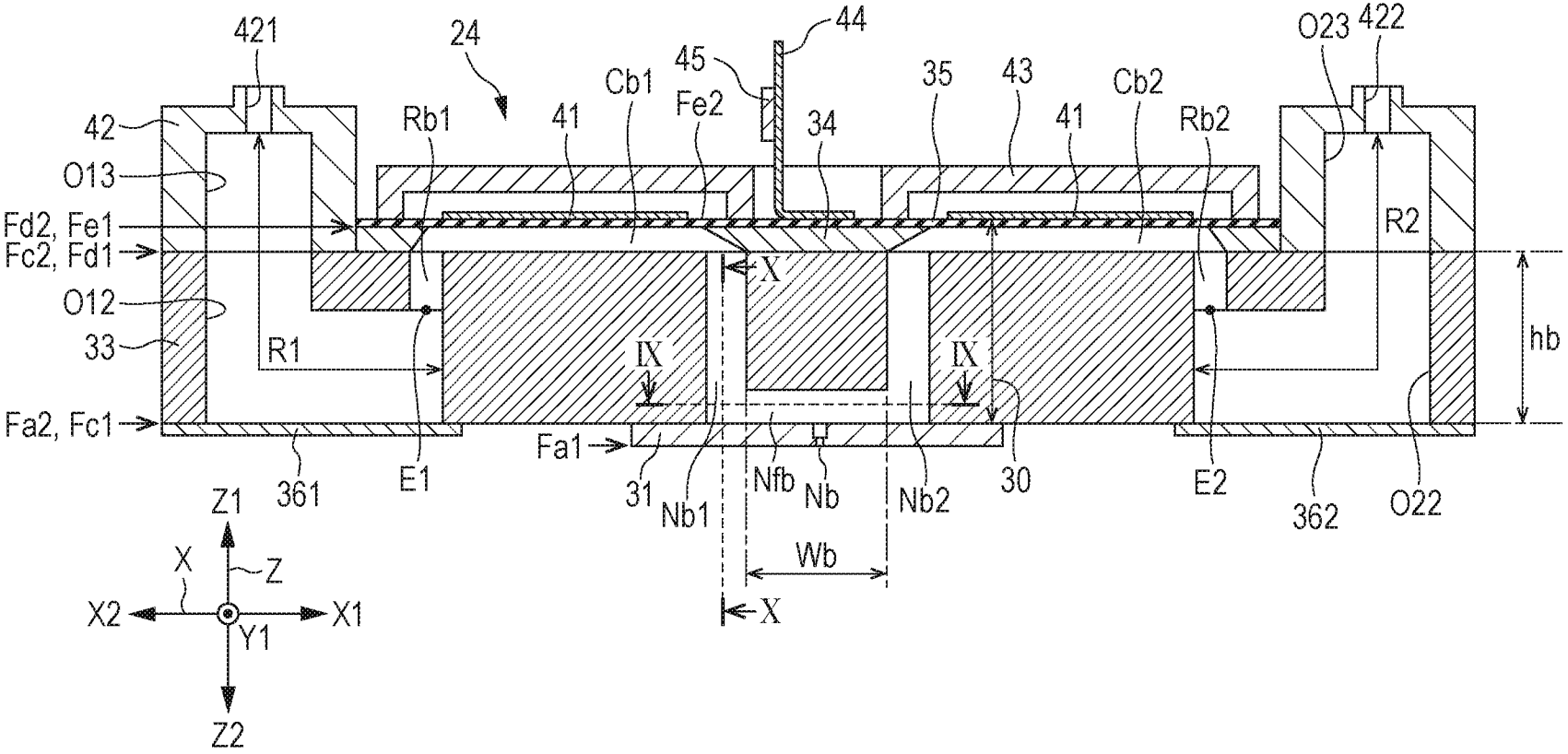
FIG. 8 is a sectional view along line VIII-VIII in FIG. 2 according to the second embodiment.

FIG. 7 is a sectional view along line VII-VII in FIG. 2 according to a second embodiment, and FIG. 8 is a sectional view along line VIII-VIII in FIG. 2 according to the second embodiment. In the following description, configurations similar to those of the first embodiment will be given the same reference symbols, and detailed description thereof will be omitted or description thereof will be simplified.

The liquid ejecting head 24 of the second embodiment differs from that of the first embodiment in the channel lengths and channel widths of the nozzle channel Nfa and the nozzle channel Nfb. Specifically, width Wa of the nozzle channel Nfa in direction X1 is smaller than width ha of each of the first communication channel Na1 and the second communication channel Na2 in direction Z1. That is, the channel length of the nozzle channel Nfa is shorter than the channel length of the first communication channel Na1 and the channel length of the second communication channel Na2.

Figure 9:
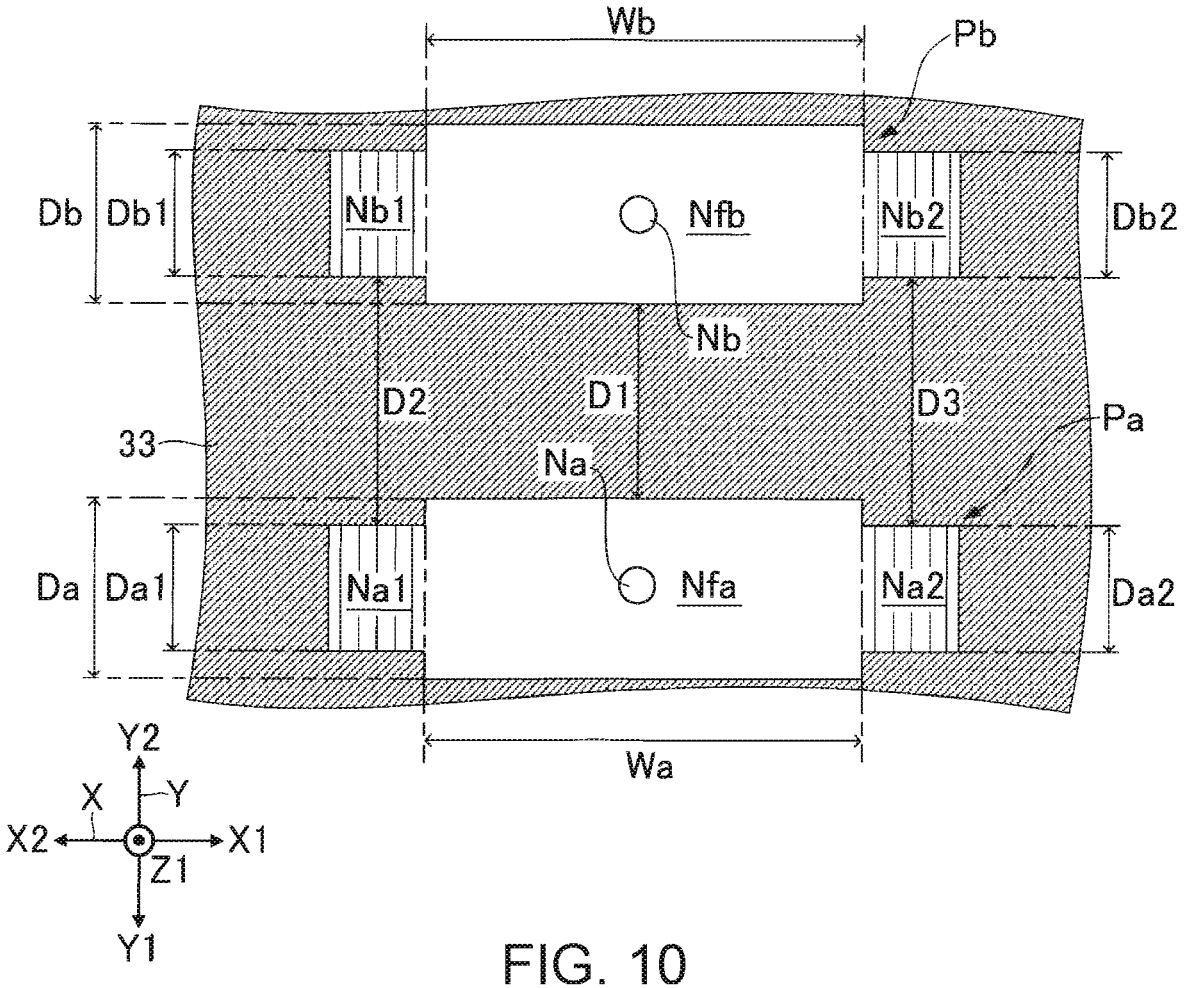
FIG. 9 is a partial sectional view along line IX-IX in FIGS. 7 and 8.
Figure 10:
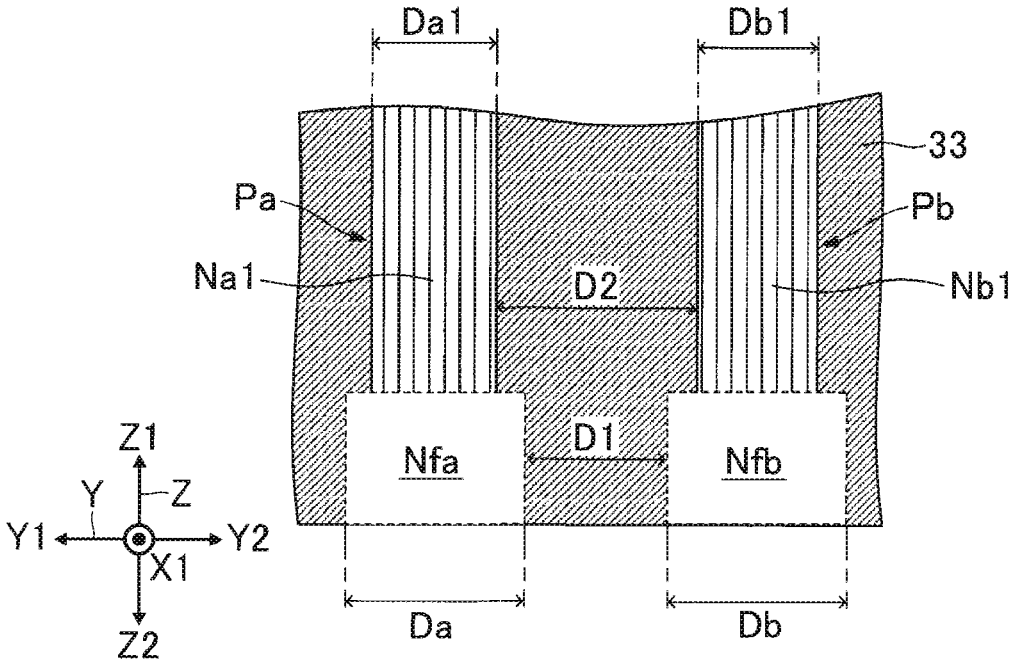
FIG. 10 is a partial sectional view along line X-X in FIGS. 7 and 8.

FIG. 9 is a partial sectional view along line IX-IX in FIGS. 7 and 8, and FIG. 10 is a partial sectional view along line X-X in FIGS. 7 and 8. In FIG. 10, illustration of the nozzle substrate 31 will be omitted.

Width Da of the nozzle channel Nfa in direction Y2 is larger than width Da1 of the first communication channel Na1 in direction Y2 and larger than width Da2 of the second communication channel Na2 in direction Y2. Similarly, width Db of the nozzle channel Nfb in direction Y2 is larger than width Db1 of the third communication channel Nb1 in direction Y2 and larger than width Db2 of the fourth communication channel Nb2 in direction Y2.

Moreover, as illustrated in FIG. 9, a distance between the nozzle channel Nfa and the nozzle channel Nfb in the Y-axis direction, that is, thickness D1 of the partition provided between the nozzle channel Nfa and the nozzle channel Nfb in the Y-axis direction is smaller than thickness D2 of the partition provided between the first communication channel Na1 and the third communication channel Nb1 in the Y-axis direction and thickness D3 of the partition provided between the second communication channel Na2 and the fourth communication channel Nb2 in the Y-axis direction.

Further, in the second embodiment, the sectional area of the nozzle channel Nfa as viewed in the X-axis direction is larger than the sectional area of the first communication channel Na1 and the sectional area of the second communication channel Na2, which are indicated by vertical lines in FIG. 9, as viewed in the Z-axis direction. Similarly, the sectional area of the nozzle channel Nfb as viewed in the X-axis direction is larger than the sectional area of the third communication channel Nb1 and the sectional area of the fourth communication channel Nb2, which are indicated by vertical lines in FIG. 9, as viewed in the Z-axis direction.

In the second embodiment, width Wa of the nozzle channel Nfa and width Wb of the nozzle channel Nfb in direction X1 are smaller than width ha of the first communication channel Na1 and width hb of the third communication channel Nb1 in direction Z1. Thus, when it is assumed that the widths of the respective channels in the Y-axis direction are the same, structural crosstalk can occur significantly between the first communication channel Na1 and the third communication channel Nb1 rather than between the nozzle channel Nfa and the nozzle channel Nfb.

In view of the foregoing, in the second embodiment, as illustrated in FIGS. 9 and 10, it is possible to set width Da1 of the first communication channel Na1 and width Db1 of the third communication channel Nb1 in the Y-axis direction to relatively small values. This makes it possible to relatively increase thickness D2 of the partition between the first communication channel Na1 and the third communication channel Nb1, and even when vibration is generated in one of the communication channels, the vibration is difficult to be transferred to the other communication channel. The same is applicable to a portion between the second communication channel Na2 and the fourth communication channel Nb2. Accordingly, it is possible to reduce structural crosstalk between the first communication channel Na1 and the third communication channel Nb1 and between the second communication channel Na2 and the fourth communication channel Nb2.

On the other hand, in the second embodiment, relatively increasing width Da of the nozzle channel Nfa and width Db of the nozzle channel Nfb in the Y-axis direction, in which structural crosstalk is less likely to occur, is able to suppress an increase in channel resistance.

As described above, according to the second embodiment, it is possible to reduce structural crosstalk between the communication channels while suppressing an increase in channel resistance of each of the nozzle channels.

C: Third Embodiment

Figure 11:
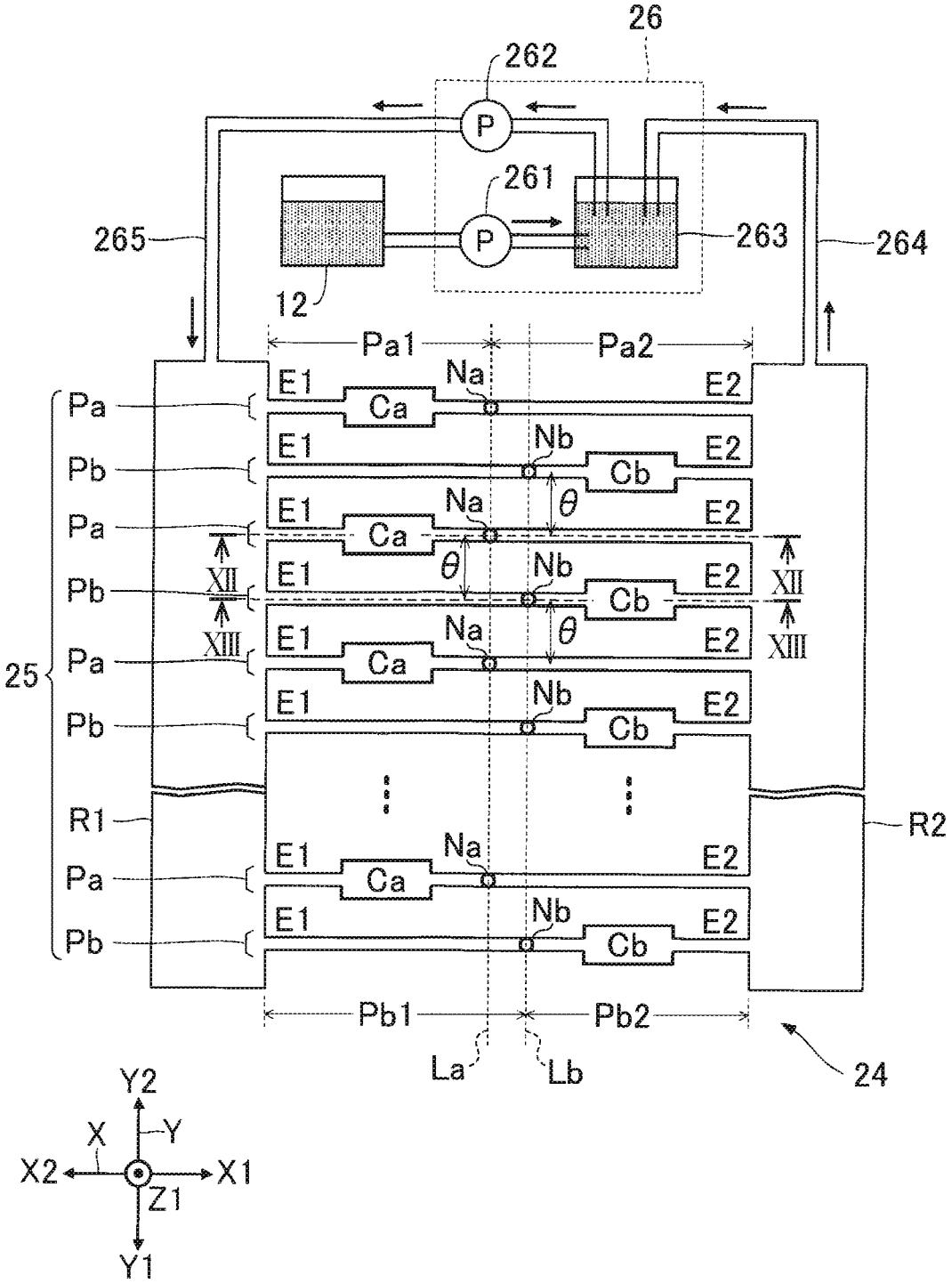
FIG. 11 is a schematic view illustrating an example of a partial configuration of a liquid ejecting apparatus according to a third embodiment.

FIG. 11 is a schematic view illustrating a channel structure of the liquid ejecting head 24 when the liquid ejecting head 24 according to the third embodiment is viewed in the Z-axis direction. As illustrated in FIG. 11, a plurality of nozzles N (Na, Nb) are formed on the surface of the liquid ejecting head 24, which faces the medium 11. The plurality of nozzles N are arrayed in the Y-axis direction. The plurality of nozzles N eject the ink in the Z-axis direction. That is, the Z-axis corresponds to a direction in which the respective nozzles N eject the ink.

The plurality of nozzles N in the third embodiment are divided into a first nozzle row La and a second nozzle row Lb. The first nozzle row La is a set of a plurality of nozzles Na that are aligned on the straight line in the Y-axis direction. Similarly, the second nozzle row Lb is a set of a plurality of nozzles Nb that are aligned on the straight line in the Y-axis direction. The first nozzle row La and the second nozzle row Lb are arranged side by side with a given gap therebetween in the X-axis direction. The position of each of the nozzles Na in the Y-axis direction and the position of each of the nozzles Nb in the Y-axis direction differ from each other. As illustrated in FIG. 11, the plurality of nozzles N including the nozzles Na and the nozzles Nb are arrayed with a pitch (cycle) 0. The pitch θ is a distance between the center of a nozzle Na and the center of an adjacent nozzle Nb in the Y-axis direction.

As illustrated in FIG. 11, the individual channel row 25 is disposed in the liquid ejecting head 24. The individual channel row 25 is a set of a plurality of individual channels P (Pa, Pb) corresponding to different nozzles N. The plurality of individual channels P are channels that communicate with the nozzles N corresponding to the individual channels P. The individual channels P extend in the X-axis direction. The individual channel row 25 is constituted by the plurality of individual channels P that are arranged side by side in the Y-axis direction. Note that, although the respective individual channels P are illustrated with simple straight lines for convenience in FIG. 11, actual shapes of the individual channels P will be described later.

Each of the individual channels P includes the pressure chamber C (Ca, Cb). The pressure chamber C of the individual channel P is a void that accumulates the ink to be ejected from the nozzle N that communicates with the individual channel P. That is, when the pressure of the ink in the pressure chamber C changes, the ink is ejected from the nozzle N.

As illustrated in FIG. 11, the first common liquid chamber R1 and the second common liquid chamber R2 are disposed in the liquid ejecting head 24. Each of the first common liquid chamber R1 and the second common liquid chamber R2 extends in the Y-axis direction over an entire region in which the plurality of nozzles N are distributed. The individual channel row 25 and the plurality of nozzles N are positioned between the first common liquid chamber R1 and the second common liquid chamber R2 in plan view.

The plurality of individual channels P communicate with the first common liquid chamber R1 in common. Specifically, the end E1 positioned in direction X2 of each of the individual channels P is coupled to the first common liquid chamber R1. Moreover, the plurality of individual channels P communicate with the second common liquid chamber R2 in common. Specifically, the end E2 positioned in direction X1 of each of the individual channels P is coupled to the second common liquid chamber R2. As can be understood from the foregoing description, the individual channels P enable the first common liquid chamber R1 and the second common liquid chamber R2 to communicate with each other. The ink supplied from the first common liquid chamber R1 to an individual channel P is ejected from the nozzle N corresponding to the individual channel P. Moreover, of the ink supplied from the first common liquid chamber R1 to each of the individual channels P, the ink that is not ejected from the nozzle N is discharged to the second common liquid chamber R2.

As illustrated in FIG. 11, the liquid ejecting apparatus 100 of the third embodiment includes the circulation mechanism 26. The circulation mechanism 26 is a mechanism that causes the ink discharged from the respective individual channels P to the second common liquid chamber R2 to return to the first common liquid chamber R1. Specifically, the circulation mechanism 26 includes the first supply pump 261, the second supply pump 262, the accumulation container 263, the circulation channel 264, and the supply channel 265.

The first supply pump 261 is a pump that supplies the ink accumulated in the liquid container 12 to the accumulation container 263. The accumulation container 263 is a temporary storage tank that temporarily stores the ink supplied from the liquid container 12. The circulation channel 264 is a channel that enables the second common liquid chamber R2 and the accumulation container 263 to communicate with each other. The ink accumulated in the liquid container 12 is supplied from the first supply pump 261 to the accumulation container 263, and the ink discharged from the respective individual channels P to the second common liquid chamber R2 is additionally supplied to the accumulation container 263 via the circulation channel 264. The second supply pump 262 is a pump that discharges the ink accumulated in the accumulation container 263. The ink discharged from the second supply pump 262 is supplied to the first common liquid chamber R1 via the supply channel 265.

The plurality of individual channels P of the individual channel row 25 include a plurality of individual channels Pa and a plurality of individual channels Pb. Each of the plurality of individual channels Pa is an individual channel P that communicates with a corresponding nozzle Na of the first nozzle row La. Each of the plurality of individual channels Pb is an individual channel P that communicates with a corresponding nozzle Nb of the second nozzle row Lb. The individual channel Pa and the individual channel Pb are alternately arrayed in the Y-axis direction. That is, the individual channel Pa and the individual channel Pb are adjacent to each other in the Y-axis direction.

The individual channel Pa includes a first portion Pa1 and a second portion Pa2. The first portion Pa1 of the individual channel Pa is a channel between the end E1 of the individual channel Pa, which is coupled to the first common liquid chamber R1, and the nozzle Na that communicates with the individual channel Pa. The first portion Pa1 includes a pressure chamber Ca. On the other hand, the second portion Pa2 of the individual channel Pa is a channel between the nozzle Na, which communicates with the individual channel Pa, and the end E2 of the individual channel Pa, which is coupled to the second common liquid chamber R2.

The individual channel Pb includes a third portion Pb1 and a fourth portion Pb2. The third portion Pb1 of the individual channel Pb is a channel between the end E1 of the individual channel Pb, which is coupled to the first common liquid chamber R1, and the nozzle Nb that communicates with the individual channel Pb. On the other hand, the fourth portion Pb2 of the individual channel Pb is a channel between the nozzle Nb, which communicates with the individual channel Pb, and the end E2 of the individual channel Pb, which is coupled to the second common liquid chamber R2. The fourth portion Pb2 includes a pressure chamber Cb.

As can be understood from the foregoing description, a plurality of pressure chambers Ca corresponding to different nozzles Na of the first nozzle row La are aligned on the straight line in the Y-axis direction. Similarly, a plurality of pressure chambers Cb corresponding to different nozzles Nb of the second nozzle row Lb are aligned on the straight line in the Y-axis direction. The array of the plurality of pressure chambers Ca and the array of the plurality of pressure chambers Cb are arranged side by side with a given gap therebetween in the X-axis direction. The position of each of the pressure chambers Ca in the Y-axis direction differs from the position of each of the pressure chambers Cb in the Y-axis direction.

Additionally, as can be understood from FIG. 11, first portions Pa1 of the individual channels Pa and third portions Pb1 of the individual channels Pb are arrayed in the Y-axis direction, and second portions Pa2 of the individual channels Pa and fourth portions Pb2 of the individual channels Pb are arrayed in the Y-axis direction.

Figure 12:
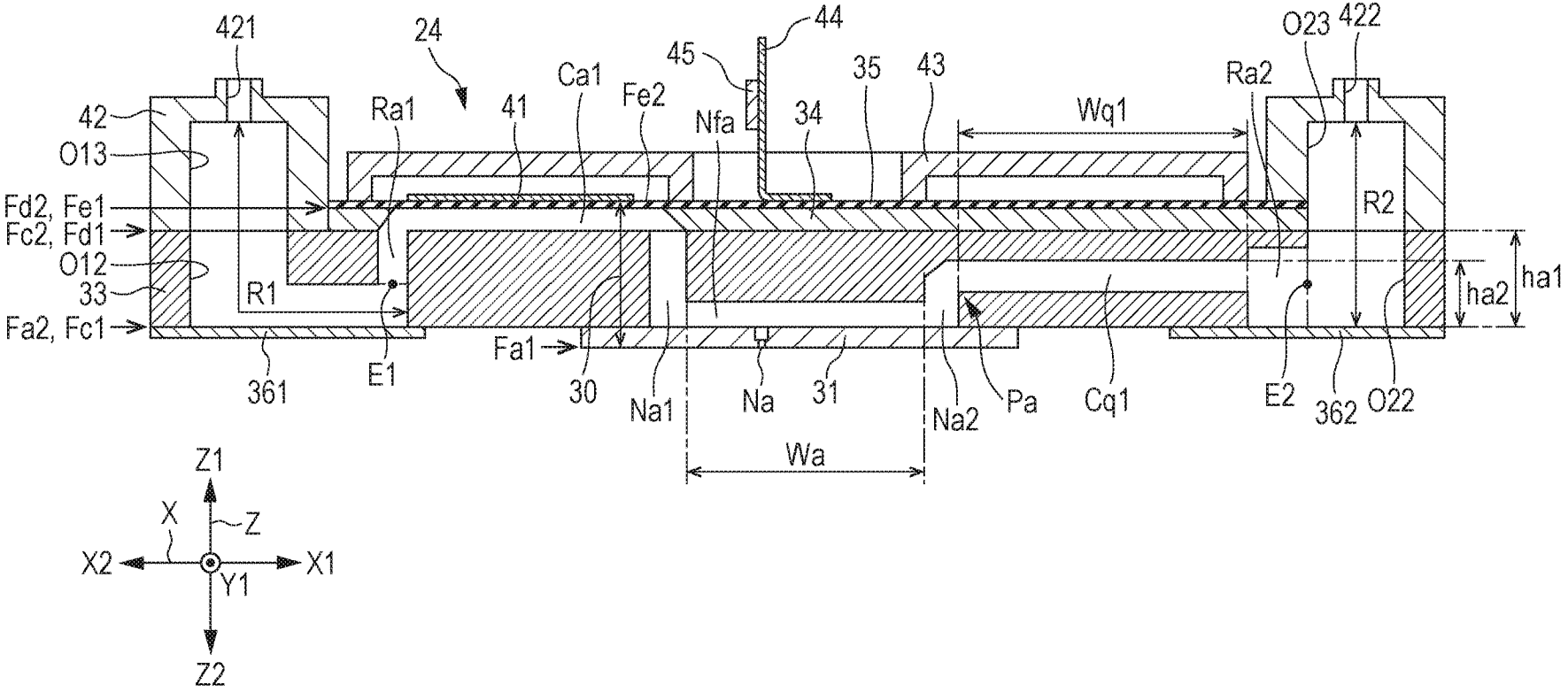
FIG. 12 is a sectional view along line XII-XII in FIG. 11.
Figure 13:
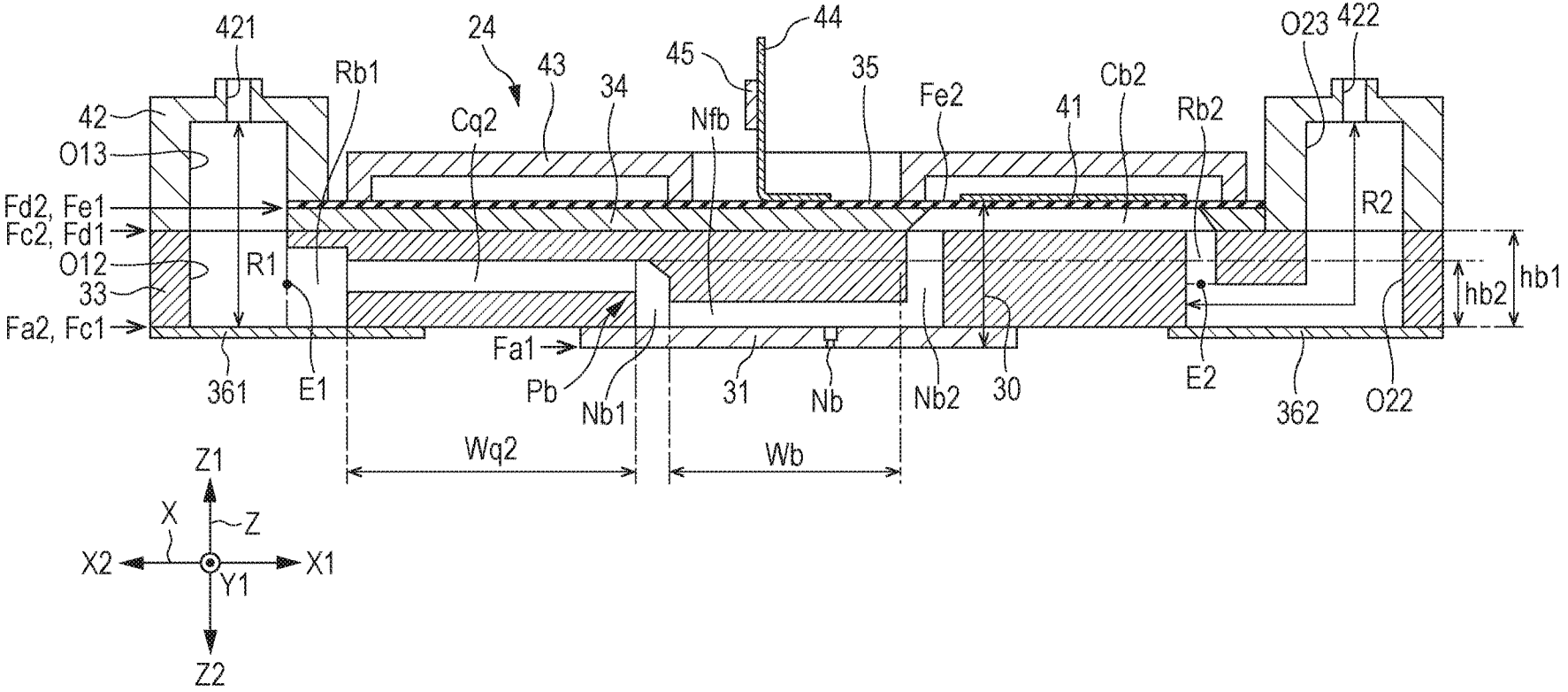
FIG. 13 is a sectional view along line XIII-XIII in FIG. 11.

A specific configuration of the liquid ejecting head 24 will be described in detail below. FIG. 12 is a sectional view along line XII-XII in FIG. 11, and FIG. 13 is a sectional view along line XIII-XIII in FIG. 11. FIG. 12 illustrates a sectional surface that passes through the individual channel Pa, and FIG. 13 illustrates a sectional surface that passes through the individual channel Pb.

As illustrated in FIGS. 12 and 13, the liquid ejecting head 24 includes the channel structure 30, the plurality of piezoelectric elements 41, the housing 42, the protection substrate 43, and the wiring substrate 44. The channel structure 30 is a structure in which a channel having the first common liquid chamber R1, the second common liquid chamber R2, the plurality of individual channels P, and the plurality of nozzles N is formed.

The channel structure 30 is a structure in which the nozzle substrate 31, the communication plate 33, the pressure chamber substrate 34, and the vibrating plate 35 are layered in this order in direction Z1. The members that constitute the channel structure 30 are each manufactured such that, for example, a silicon monocrystalline substrate is processed by using a semiconductor manufacturing method.

The plurality of nozzles N are formed at the nozzle substrate 31. The plurality of nozzles N are through holes each of which has a cylindrical shape and which enable the ink to pass therethrough. The nozzle substrate 31 of the third embodiment is a plate member that has the surface Fa1 positioned in direction Z2 and the surface Fa2 positioned in direction Z1.

The communication plate 33 in FIGS. 12 and 13 is a plate member that includes the surface Fc1 positioned in direction Z2 and the surface Fc2 positioned in direction Z1.

The pressure chamber substrate 34 is a plate member that includes the surface Fd1 positioned in direction Z2 and the surface Fd2 positioned in direction Z1. The vibrating plate 35 is a plate member that includes the surface Fe1 positioned in direction Z2 and the surface Fe2 positioned in direction Z1.

The members that constitute the channel structure 30 are each formed into a rectangular shape, which is elongated in the Y-axis direction, and are bonded to each other, for example, with an adhesive. For example, the surface Fa2 of the nozzle substrate 31 is bonded to the surface Fc1 of the communication plate 33. The surface Fc2 of the communication plate 33 is bonded to the surface Fd1 of the pressure chamber substrate 34, and the surface Fd2 of the pressure chamber substrate 34 is bonded to the surface Fe1 of the vibrating plate 35.

The space O12 and the space O22 are formed in the communication plate 33. The space O12 and the space O22 are openings that are elongated in the Y-axis direction. The vibration absorber 361 that closes the space O12 and the vibration absorber 362 that closes the space O22 are disposed on the surface Fc1 of the communication plate 33. The vibration absorber 361 and the vibration absorber 362 are layer members formed of an elastic material.

The housing 42 is a case for accumulating the ink. The housing 42 is bonded to the surface Fc2 of the communication plate 33. The space O13 that communicates with the space O12 and the space O23 that communicates with the space O22 are formed in the housing 42. The space O13 and the space O23 are spaces that are elongated in the Y-axis direction. The space O12 and the space O13 communicate with each other to constitute the first common liquid chamber R1. Similarly, the space O12 and the space O23 communicate with each other to constitute the second common liquid chamber R2. The vibration absorber 361 constitutes the wall surface of the first common liquid chamber R1 and absorbs a change in the pressure of the ink in the first common liquid chamber R1. The vibration absorber 362 constitutes the wall surface of the second common liquid chamber R2 and absorbs a change in the pressure of the ink in the second common liquid chamber R2.

The supply port 421 and the discharge port 422 are formed in the housing 42. The supply port 421 is a pipeline, which communicates with the first common liquid chamber R1, and is coupled to the supply channel 265 of the circulation mechanism 26. The ink discharged from the second supply pump 262 to the supply channel 265 is supplied to the first common liquid chamber R1 via the supply port 421. On the other hand, the discharge port 422 is a pipeline, which communicates with the second common liquid chamber R2, and is coupled to the circulation channel 264 of the circulation mechanism 26. The ink in the second common liquid chamber R2 is supplied to the circulation channel 264 via the discharge port 422.

A plurality of pressure chambers C (Ca, Cb) are formed in the pressure chamber substrate 34. Each of the pressure chambers C is a void between the surface Fc2 of the communication plate 33 and the surface Fe1 of the vibrating plate 35. Each of the pressure chambers C is formed so as to be elongated in the X-axis direction in plan view.

The vibrating plate 35 is a plate member capable of elastically vibrating. The vibrating plate 35 is constituted by, for example, stacking a first layer made of silicon oxide ($SiO_2$) and a second layer made of zirconium oxide ($ZrO_2$). Note that the vibrating plate 35 and the pressure chamber substrate 34 may be integrally formed by a plate member of a given thickness, from which a region corresponding to the pressure chamber C in the thickness direction is removed. Moreover, the vibrating plate 35 may be formed by a single layer.

The plurality of piezoelectric elements 41 corresponding to different pressure chambers C are disposed on the surface Fe2 of the vibrating plate 35. The piezoelectric elements 41 corresponding to the respective pressure chambers C overlap the pressure chambers C in plan view. Specifically, each of the piezoelectric elements 41 is constituted by stacking a first electrode and a second electrode that face each other with a piezoelectric layer formed between both the electrodes. The piezoelectric element 41 is an energy-generating element that changes the pressure of the ink in a pressure chamber C to thereby eject the ink in the pressure chamber C from the nozzle N. That is, when the piezoelectric element 41 is deformed upon supply of a driving signal, the vibrating plate 35 vibrates, and in a case in which the pressure chamber C expands and contracts upon vibration of the vibrating plate 35, the ink is ejected from the nozzle N.

The protection substrate 43 is a plate member, which is disposed on the surface Fe2 of the vibrating plate 35, and protects the plurality of piezoelectric elements 41 and reinforces the mechanical strength of the vibrating plate 35. The plurality of piezoelectric elements 41 are housed between the protection substrate 43 and the vibrating plate 35. The wiring substrate 44 is mounted on the surface Fe2 of the vibrating plate 35. The wiring substrate 44 is a mounting component for electrically coupling the control unit 21 and the liquid ejecting head 24. For example, the wiring substrate 44 that is flexible, such as a flexible printed circuit (FPC) or flexible flat cable (FFC), is suitably used. The drive circuit 45 for supplying a driving signal to each of the piezoelectric elements 41 is mounted on the wiring substrate 44.

Next, a detailed configuration of the individual channel P will be described. The shape of the individual channel Pa and the shape of the individual channel Pb have a rotationally symmetrical relationship centering about a symmetry axis parallel to the Z-axis in plan view.

As illustrated in FIG. 12, the individual channel Pa includes the supply channel Ra1, the pressure chamber Ca1, the first communication channel Na1, the nozzle channel Nfa, the second communication channel Na2, a lateral communication channel Cq1, and the discharge channel Ra2. The individual channel Pa is a channel in which the aforementioned elements are integrally formed and coupled in this order.

The supply channel Ra1 is a space formed in the communication plate 33. Specifically, as illustrated in FIG. 12, the supply channel Ra1 extends, in the Z-axis direction, from the space O12 that constitutes the first common liquid chamber R1 to the surface Fc2 of the communication plate 33. The end of the supply channel Ra1, which is coupled to the space O12, is the end E1 of the individual channel Pa. The supply channel Ra1 is a channel that communicates with the pressure chamber Ca1 and that guides, to the pressure chamber Ca1, the ink supplied from the first common liquid chamber R1. The supply channel Ra1 is an example of "a first individual supply channel".

As illustrated in FIG. 12, the first communication channel Na1 is a space that passes through the communication plate 33. The first communication channel Na1 is a channel extending in the Z-axis direction. The first communication channel Na1 extends in direction Z1 and communicates with the pressure chamber Ca1 and the nozzle channel Nfa. The first communication channel Na1 is a channel that guides, to the nozzle channel Nfa, the ink pushed out from the pressure chamber Ca1.

The nozzle channel Nfa is a channel that is provided in the communication plate 33 and that extends in the X-axis direction. The nozzle channel Nfa is positioned between the first communication channel Na1 and the second communication channel Na2 as viewed in the Z-axis direction. The nozzle Na is provided in the nozzle channel Nfa.

The second communication channel Na2 is a space provided in the communication plate 33. The second communication channel Na2 is a channel extending in the Z-axis direction. The second communication channel Na2 extends in direction Z1 and communicates with the lateral communication channel Cq1 and the nozzle channel Nfa. The second communication channel Na2 is a channel that guides, to the lateral communication channel Cq1, the ink supplied from the nozzle channel Nfa.

The lateral communication channel Cq1 is a space provided in the communication plate 33. The lateral communication channel Cq1 is a channel that is elongated in the X-axis direction. The lateral communication channel Cq1 extends in direction X1 and communicates with the second communication channel Na2 and the discharge channel Ra2. The lateral communication channel Cq1 is a channel that guides, to the discharge channel Ra2, the ink guided from the second communication channel Na2.

The discharge channel Ra2 is a space provided in the communication plate 33. The end of the discharge channel Ra2, which is coupled to the space O22, is the end E2 of the individual channel Pa. The discharge channel Ra2 is a channel that communicates with the lateral communication channel Cq1 and that guides, to the second common liquid chamber R2, the ink guided from the lateral communication channel Cq1. The discharge channel Ra2 is an example of "the first individual discharge channel".

As illustrated in FIG. 13, the individual channel Pb includes the supply channel Rb1, a lateral communication channel Cq2, the third communication channel Nb1, the nozzle channel Nfb, the fourth communication channel Nb2, the pressure chamber Cb1, and the discharge channel Rb2. The individual channel Pb is a channel in which the aforementioned elements are integrally formed and coupled in this order.

The supply channel Rb1 is a space provided in the communication plate 33. The end of the supply channel Rb1, which is coupled to the space O12, is the end E1 of the individual channel Pb. The supply channel Rb1 is a channel that communicates with the lateral communication channel Cq2 and that guides, to the lateral communication channel Cq2, the ink supplied from the first common liquid chamber R1. The supply channel Rb1 is an example of "the second individual supply channel".

The lateral communication channel Cq2 is a space provided in the communication plate 33. The lateral communication channel Cq2 is a channel that is elongated in the X-axis direction. The lateral communication channel Cq2 extends in direction X1 and communicates with the supply channel Rb1 and the third communication channel Nb1. The lateral communication channel Cq2 is a channel that guides, to the third communication channel Nb1, the ink guided from the supply channel Rb1.

As illustrated in FIG. 13, the third communication channel Nb1 is a space provided in the communication plate 33. The third communication channel Nb1 is a channel extending in the Z-axis direction. The third communication channel Nb1 extends in direction Z1 and communicates with the lateral communication channel Cq2 and the nozzle channel Nfb. The third communication channel Nb1 is a channel that guides, to the nozzle channel Nfb, the ink supplied from the lateral communication channel Cq2.

The nozzle channel Nfb is a channel that is provided in the communication plate 33 and that extends in the X-axis direction. The nozzle channel Nfb is positioned between the third communication channel Nb1 and the fourth communication channel Nb2 as viewed in the Z-axis direction. The nozzle Nb is provided in the nozzle channel Nfb.

The fourth communication channel Nb2 is a space that passes through the communication plate 33. The fourth communication channel Nb2 is a channel extending in the Z-axis direction. The fourth communication channel Nb2 extends in direction Z1 and communicates with the pressure chamber Cb1 and the nozzle channel Nfb. The fourth communication channel Nb2 is a channel that guides, to the pressure chamber Cb1, the ink supplied from the nozzle channel Nfb.

The discharge channel Rb2 is a space provided in the communication plate 33. The end of the discharge channel Rb2, which is coupled to the space O22, is the end E2 of the individual channel Pb. The discharge channel Rb2 is a channel that communicates with the pressure chamber Cb1 and that guides, to the second common liquid chamber R2, the ink pushed out from the pressure chamber Cb1. The discharge channel Rb2 is an example of "the second individual discharge channel".

In FIGS. 12 and 13, regarding the individual channel Pa and the individual channel Pb that are adjacent to each other, the individual channel Pa has neither a channel adjacent to the pressure chamber Ca1 in the Y-axis direction nor a channel adjacent to the lateral communication channel Cq1 in the Y-axis direction. Additionally, the individual channel Pb has neither a channel adjacent to the pressure chamber Cb1 in the Y-axis direction nor a channel adjacent to the lateral communication channel Cq2 in the Y-axis direction. Thus, even when the pitch θ is reduced, structural crosstalk is less likely to occur compared with the first and second embodiments. As a result, it is possible to reduce the pitch θ and enhance nozzle resolution in the Z-axis direction and to record a high-quality image.

In the liquid ejecting head 24 of the third embodiment, the sectional area of the nozzle channel Nfa as viewed in the X-axis direction is smaller than the sectional area of the first communication channel Na1 and the sectional area of the second communication channel Na2 as viewed in the Z-axis direction. The sectional area of the nozzle channel Nfb as viewed in the X-axis direction is smaller than the sectional area of the third communication channel Nb1 and the sectional area of the fourth communication channel Nb2 as viewed in the Z-axis direction.

The reason for adopting such a configuration will be described. Note that, for simplification, the following description will be given with reference to only the nozzle channel Nfa and the nozzle channel Nfb, and the first communication channel Na1 and the third communication channel Nb1. Although no particular description will be given for the second communication channel Na2 and the fourth communication channel Nb2, regarding the relationship between the nozzle channel Nfa and the nozzle channel Nfb, the description for the first communication channel Na1 and the third communication channel Nb1 is applicable similarly to the second communication channel Na2 and the fourth communication channel Nb2.

In the third embodiment, since the third communication channel Nb1 is shorter than the first communication channel Na1 in direction Z1, the width of a portion in which the first communication channel Na1 and the third communication channel Nb1 overlap each other in direction Z1 is width hb2 of the third communication channel Nb1. That is, width Wa of a portion in which the nozzle channel Nfa and the nozzle channel Nfb overlap each other in direction X1 is larger than width hb2 of the portion in which the first communication channel Na1 and the third communication channel Nb1 overlap each other in direction Z1. Accordingly, the widths of the nozzle channel Nfa and the nozzle channel Nfb in the Y-axis direction are set to relatively small values to reduce structural crosstalk.

On the other hand, the width of the portion in which the first communication channel Na1 and the third communication channel Nb1 overlap each other in direction Z1 is narrow, and the first communication channel Na1 and the third communication channel Nb1 are less subject to structural crosstalk, and therefore, the sectional areas thereof in the Y-axis direction are relatively increased. Thereby, an increase in channel resistance is suppressed.

As described above, according to the third embodiment, it is possible to reduce structural crosstalk between the nozzle channels while suppressing an increase in channel resistance of each of the communication channels.

Note that, when width Wa of the portion in which the nozzle channel Nfa and the nozzle channel Nfb overlap each other in direction X1 is smaller than width hb2 of the portion in which the first communication channel Na1 and the third communication channel Nb1 overlap each other in direction Z1, the nozzle channel Nfa and the nozzle channel Nfb may be relatively widened in the Y-axis direction and the first communication channel Na1 and the third communication channel Nb1 may be relatively narrowed in the Y-axis direction.

D: Other Embodiments

The configuration of the liquid ejecting head 24 is not limited to the configurations exemplified in the first embodiment to the third embodiment described above. The liquid ejecting head 24 may have a configuration in which any two or more configurations selected from the configurations exemplified in the first embodiment to the third embodiment are combined as long as the configurations do not contradict each other.

E: Modified Examples

Although the embodiments of the disclosure have been described above, the disclosure is not limited to the embodiments described above, and various modifications can be added. Specific modified aspects that can be added to the aforementioned aspects will be exemplified below. Any aspects selected from the following examples may be appropriately combined as long as the aspects do not contradict each other. Note that, in the following examples, regarding the individual channel Pa and the individual channel Pb that have the same configuration, the configuration of the individual channel Pa will be mainly described as a representative configuration.

Modified Example 1

Figure 14:
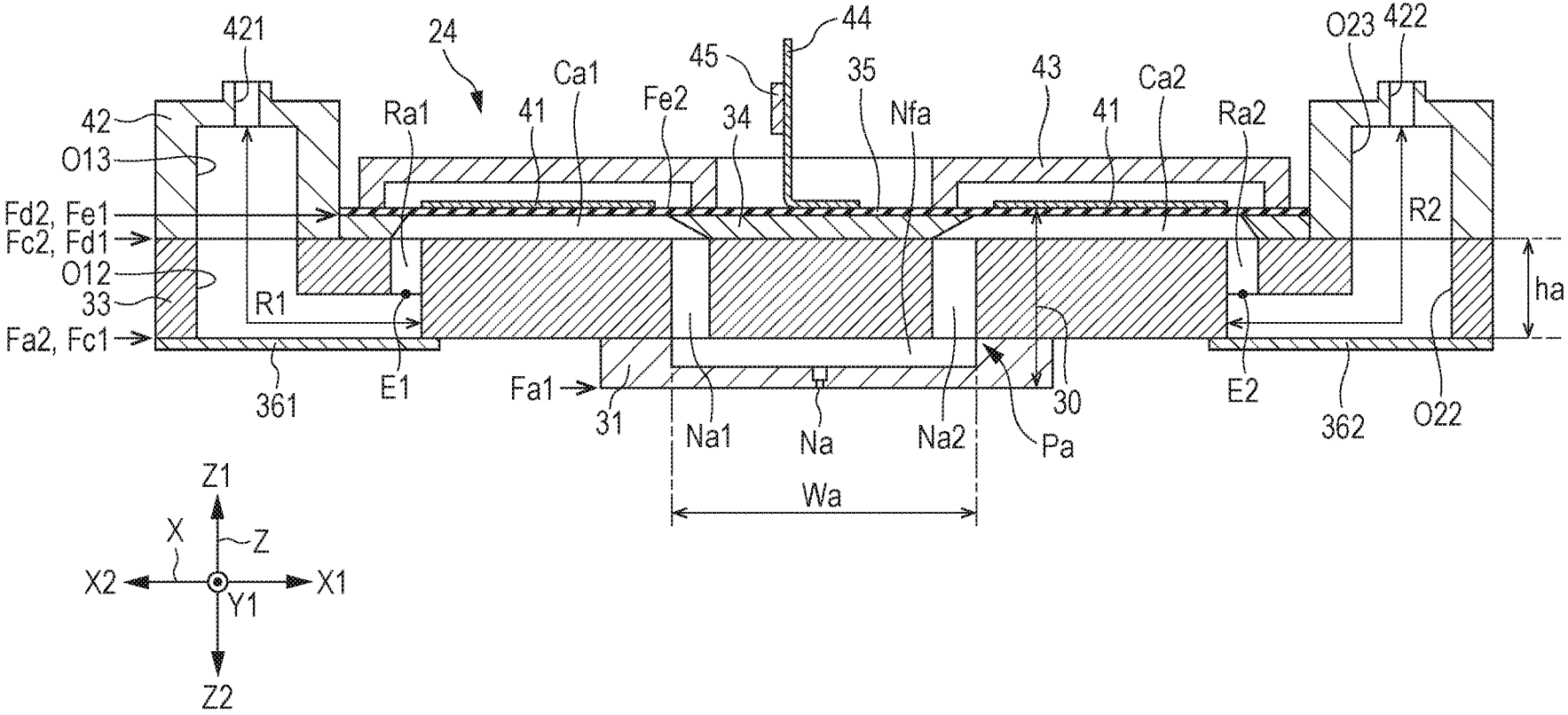
FIG. 14 is a sectional view along line XIV-XIV in FIG. 2 according to a modified example.

FIG. 14 is a sectional view along line XIV-XIV in FIG. 2 according to a modified example. The configuration of the liquid ejecting head 24 is not limited to the configurations illustrated in FIGS. 2 to 13. For example, the liquid ejecting head 24 may have a configuration in which the nozzle channel Nfa is provided in the nozzle substrate 31 as illustrated in FIG. 14. In the case of the configuration, the following relation 1 and relation 2 are desirably satisfied.

Relation 1: $A \geq B$ is satisfied when $ha \leq Wa$.

Relation 2: $A < B$ is satisfied when $ha > Wa$.

Here, "A" described above is the channel sectional area of the first communication channel Na1 in the X-Y plane, and "B" described above is the channel sectional area of the nozzle channel Nfa in the Z-Y plane. The definitions of "A" and "B" are similarly applicable to the following description.

Modified Example 2

Figure 15:
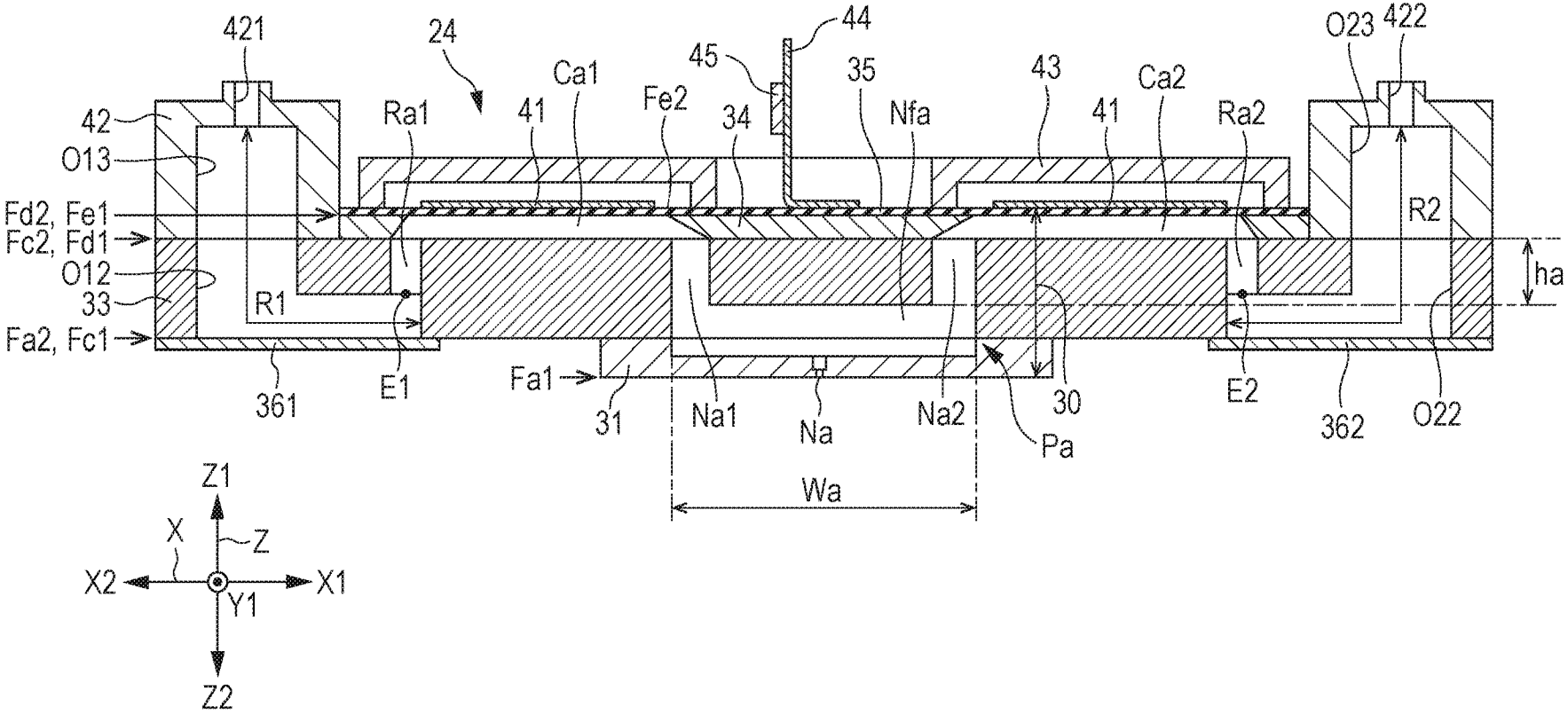
FIG. 15 is a sectional view along line XV-XV in FIG. 2 according to a modified example.

FIG. 15 is a sectional view along line XV-XV in FIG. 2 according to a modified example. Although the configuration in which the nozzle channel Nfa is provided in the communication plate 33 is exemplified in the aforementioned aspect, the nozzle channel Nfa may be provided across the nozzle substrate 31 and the communication plate 33 as illustrated in FIG. 15. In the case of such a configuration, the relation 1 and the relation 2 described above are desirably satisfied.

Modified Example 3

Figure 16:
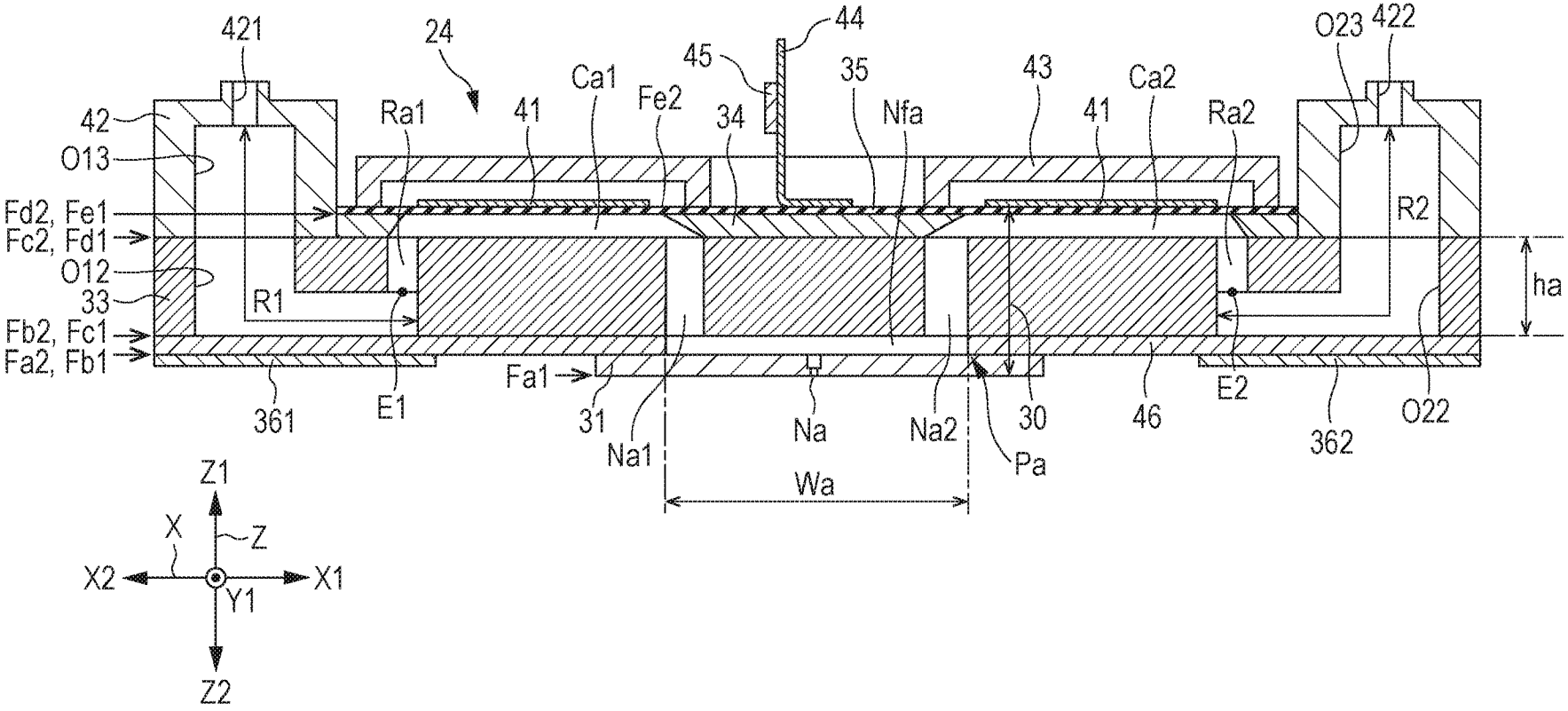
FIG. 16 is a sectional view along line XVI-XVI in FIG. 2 according to a modified example.

FIG. 16 is a sectional view along line XVI-XVI in FIG. 2 according to a modified example. Although the configuration in which the nozzle substrate 31 is provided in the communication plate 33 is exemplified in the aforementioned aspect, a communication plate 46 may be provided between the nozzle substrate 31 and the communication plate 33. In this case, the nozzle channel Nfa is provided in the communication plate 46 as illustrated in FIG. 16. In the case of the configuration exemplified in the modified example 3, the relation 1 and the relation 2 described above are desirably satisfied. Note that the communication plate 46 is an example of "a second communication plate" of claims.

Modified Example 4

Figure 17:
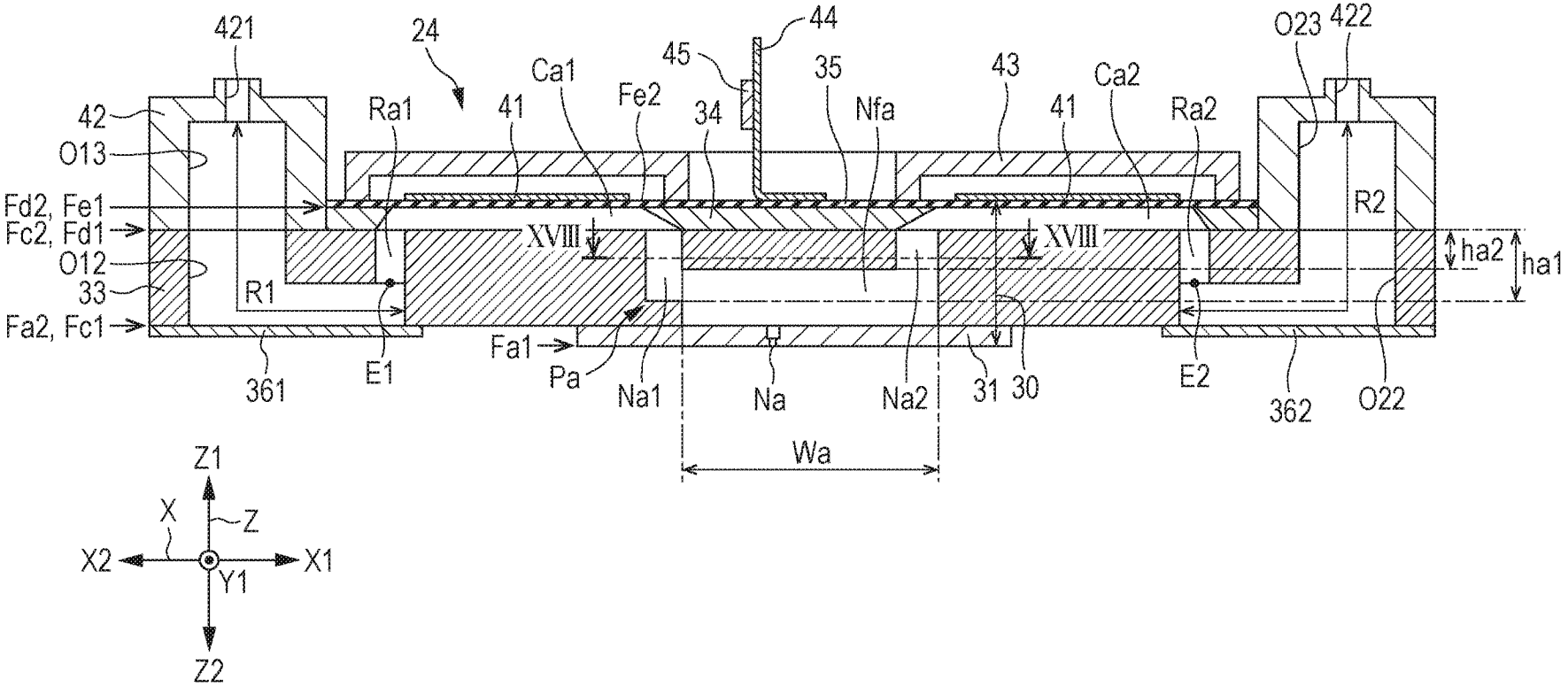
FIG. 17 is a sectional view along line XVII-XVII in FIG. 2 according to a modified example.
Figure 18:
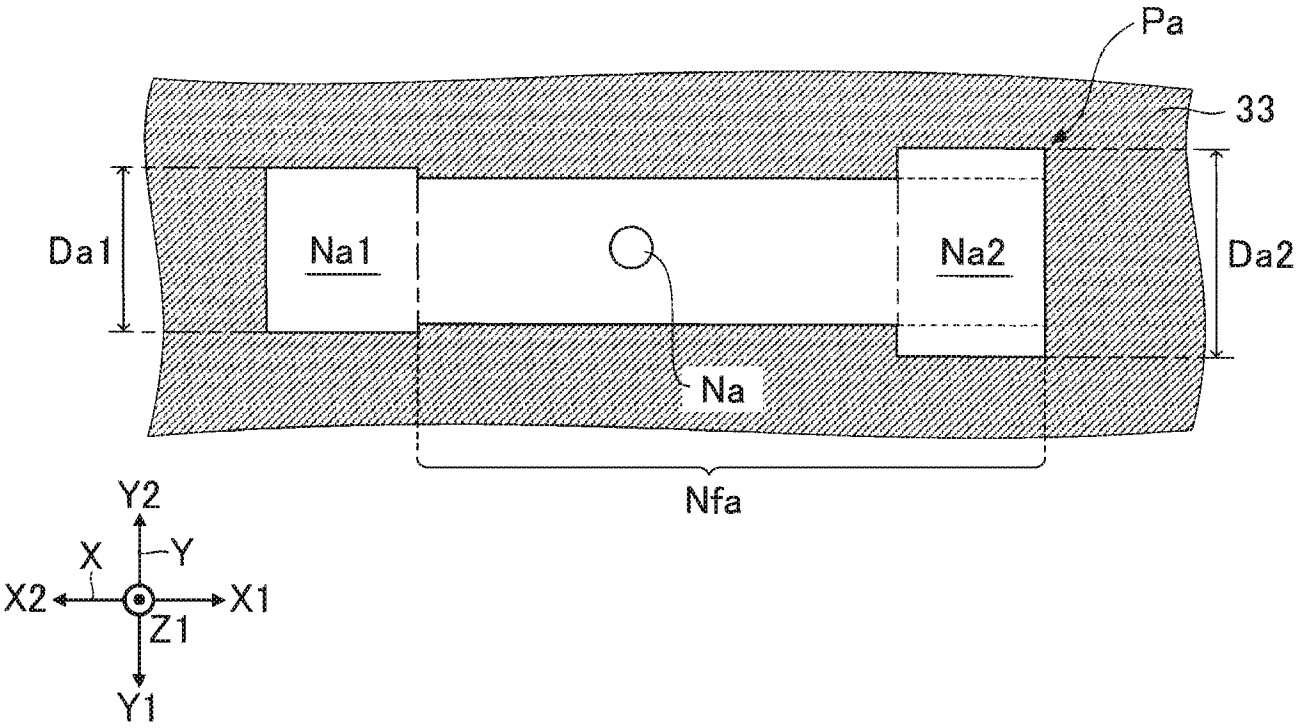
FIG. 18 is a sectional view along line XVIII-XVIII in FIG. 17.

FIG. 17 is a sectional view along line XVII-XVII in FIG. 2 according to a modified example, and FIG. 18 is a partial sectional view along line XVIII-XVIII in FIG. 17. Although the configuration in which the width of the first communication channel Na1 in direction Z1 and the width of the second communication channel Na2 in direction Z1 are the same is exemplified in the aforementioned aspect, the widths of the first communication channel Na1 and the second communication channel Na2 in direction Z1 may differ from each other. In the case of such a configuration, for example, width ha1 of the first communication channel Na1 in direction Z1 is larger than width ha2 of the second communication channel Na2 in direction Z1 as illustrated in FIG. 17. Width Da1 of the first communication channel Na1 in direction Y2 is smaller than width Da2 of the second communication channel Na2 in direction Y2 as illustrated in FIG. 18. According to such a configuration, a similar operation effect to that of the first embodiment is obtained. Note that, when the liquid ejecting head 24 adopts the configuration according to the modified example 4, the following relation 3 to relation 8 are desirably satisfied. Note that "C" described below is the channel sectional area of the second communication channel Na2 in the X-Y plane.

| | |
|---|---|
| $A \geq B \geq C$ is satisfied when $ha1 \leq Wa \leq ha2$. | Relation 3: |
| $A > B > C$ is satisfied when $ha1 < Wa < ha2$. | Relation 4: |
| $B \geq C > A$ is satisfied when $Wa \leq ha2 < ha1$. | Relation 5: |
| $B > A > C$ is satisfied when $Wa < ha1 < ha2$. | Relation 6: |
| $C > A \geq B$ is satisfied when $ha2 < ha1 \geq Wa$. | Relation 7: |
| $C > B > A$ is satisfied when $ha2 < Wa < ha1$. | Relation 8: |

Modified Example 5

Figure 19:
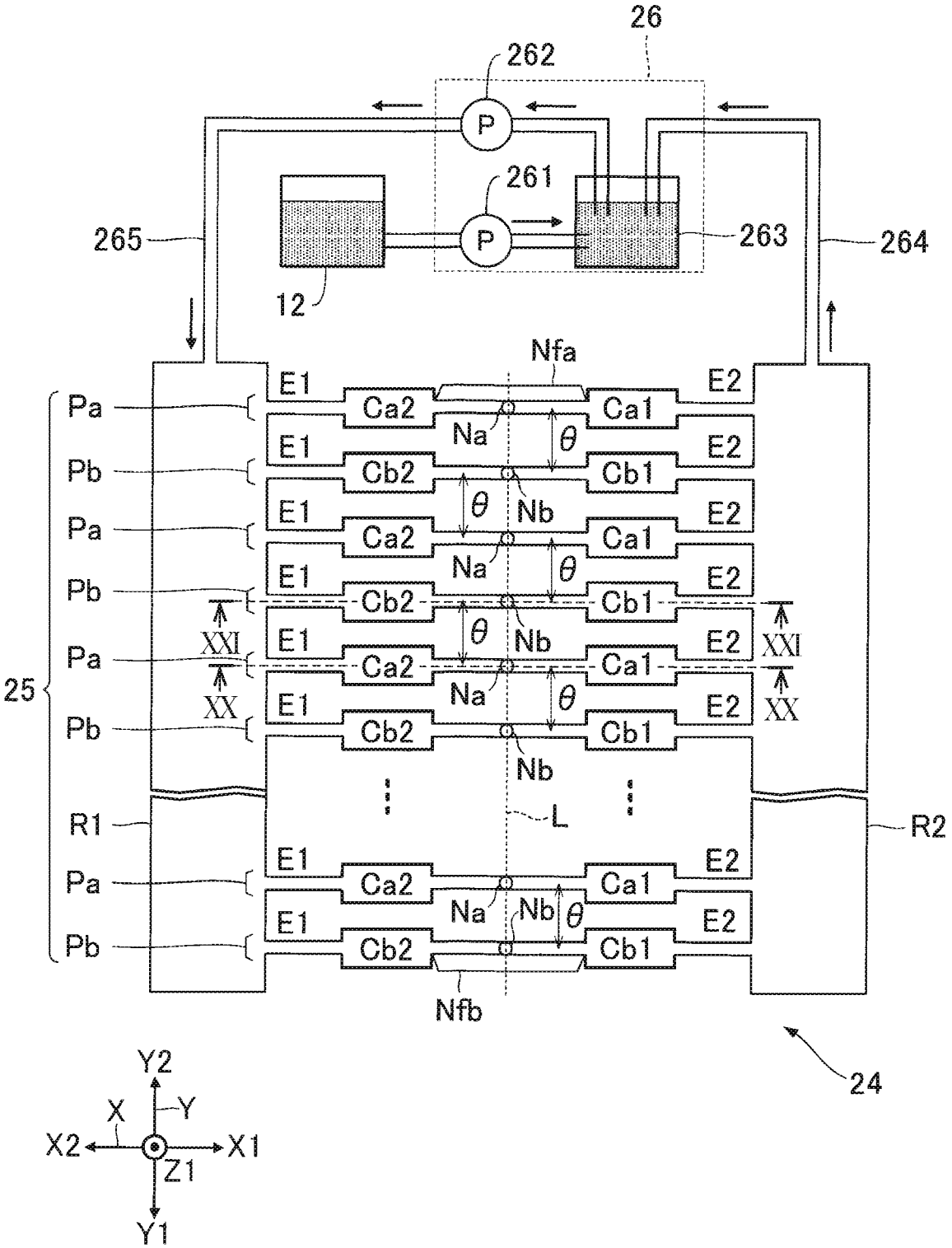
FIG. 19 is a schematic view illustrating an example of a partial configuration of a liquid ejecting apparatus according to a modified example.
Figure 20:
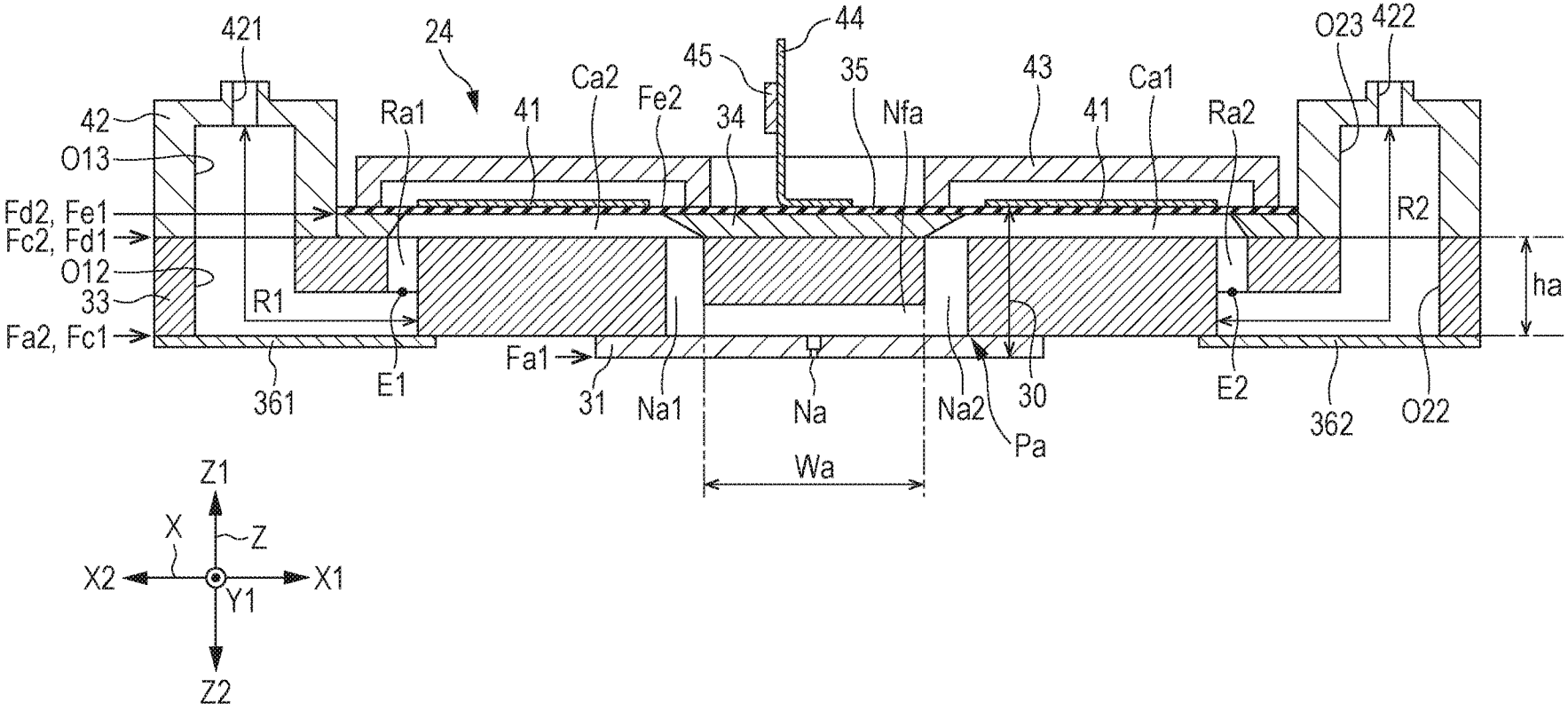
FIG. 20 is a sectional view along line XX-XX in FIG. 19.
Figure 21:
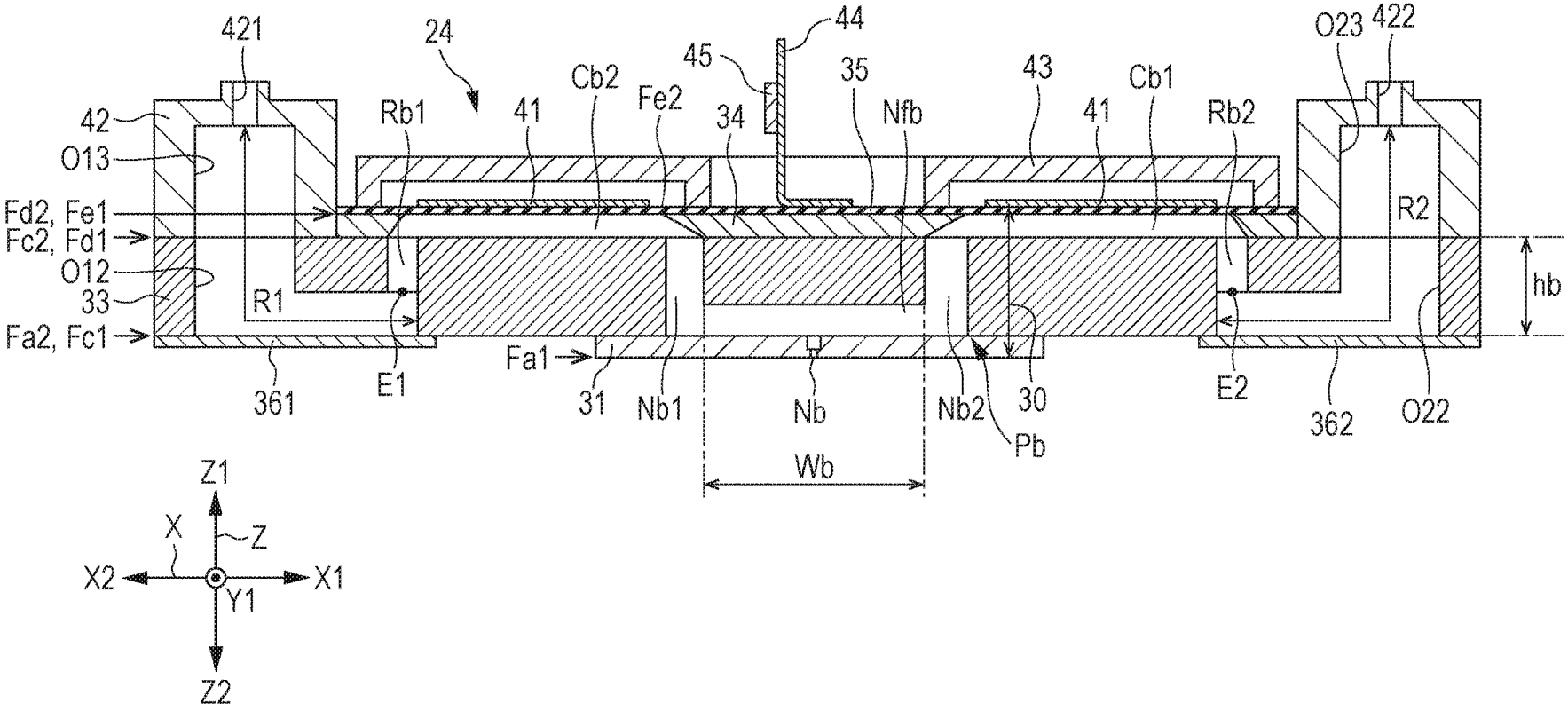
FIG. 21 is a sectional view along line XXI-XXI in FIG. 19.

FIG. 19 is a schematic view illustrating a channel structure of the liquid ejecting head 24 when the liquid ejecting head 24 according to a modified example is viewed in the Z-axis direction. FIG. 20 is a sectional view along line XX-XX in FIG. 19, and FIG. 21 is a sectional view along line XXI-XXI in FIG. 19.

In the aforementioned aspect, the pressure chamber Ca1 and the pressure chamber Cb1 are provided on the upstream and the pressure chamber Ca2 and the pressure chamber Cb2 are provided on the downstream in the direction in which the liquid ejecting head 24 causes the ink to circulate, but the pressure chamber Ca2 and the pressure chamber Cb2 may be provided on the upstream, and the pressure chamber Ca1 and the pressure chamber Cb1 may be provided on the downstream.

In the case of such a configuration, as illustrated in FIG. 20, the supply channel Ra1 is a channel that communicates with the pressure chamber Ca2 and that guides, to the pressure chamber Ca2, the ink supplied from the first common liquid chamber R1. Similarly, as illustrated in FIG. 21, the supply channel Rb1 is a channel that communicates with the pressure chamber Cb2 and that guides, to the pressure chamber Cb2, the ink supplied from the first common liquid chamber R1. The supply channel 265 according to the modified example 5 is used in common to supply the liquid to the supply channel Ra1 and the supply channel Rb1.

As illustrated in FIG. 20, the discharge channel Ra2 of the liquid ejecting head 24 according to the modified example 5 is a channel that communicates with the pressure chamber Ca1 and that guides, to the second common liquid chamber R2, the ink pushed out from the pressure chamber Ca1. Similarly, as illustrated in FIG. 21, the discharge channel Rb2 is a channel that communicates with the pressure chamber Cb1 and that guides, to the second common liquid chamber R2, the ink pushed out from the pressure chamber Cb1. The circulation channel 264 according to the modified example 5 is a channel, which enables the second common liquid chamber R2 and the accumulation container 263 to communicate with each other, and is used in common to discharge the ink from the discharge channel Ra2 and the discharge channel Rb2 via the second common liquid chamber R2.

Modified Example 6

The energy-generating element that changes the pressure of the ink in the pressure chamber C is not limited to the piezoelectric element 41 exemplified in the aforementioned aspect. For example, a heating element that generates air bubbles in the pressure chamber C by heating and thereby changes the pressure of the ink may be used as the energy-generating element.

Modified Example 7

Although the liquid ejecting apparatus 100 of a serial type in which the transport body 231 on which the liquid ejecting head 24 is mounted is reciprocated has been exemplified in the aforementioned aspect, the disclosure is applicable to a liquid ejecting apparatus of a line type in which a plurality of nozzles N are distributed over the entire width of the medium 11.

F: Supplemental Note

The configuration of the liquid ejecting apparatus 100 is not limited to the configurations exemplified in FIGS. 2 to 21, and a general liquid ejecting apparatus which causes the ink to circulate and which has a configuration different from the configurations illustrated in the drawings may be used, for example. Further, the liquid ejecting apparatus 100 exemplified in the aforementioned aspect may be adopted for various apparatuses such as a facsimile apparatus and a copying machine in addition to equipment dedicated to printing, and the use of the disclosure is not particularly limited. Needless to say, the liquid ejecting apparatus is not limited to being used for printing. For example, a liquid ejecting apparatus that ejects a solution of a color material is used as a manufacturing apparatus that forms a color filter of a display apparatus such as a liquid crystal display panel. Further, a liquid ejecting apparatus that ejects a solution of a conductive material is used as a manufacturing apparatus that forms a wire and an electrode of a wiring substrate. In addition, a liquid ejecting apparatus that ejects an organic solution regarding a living body is used as a manufacturing apparatus that manufactures a biochip, for example.

Additionally, the effects described herein are merely demonstrative or illustrative and are not limited. In other words, the disclosure can exhibit other effects obvious to a person skilled in the art from the descriptions herein together with or in place of the aforementioned effects.

Although the suitable embodiments of the disclosure have been described in detail above with reference to the accompanying drawings, the disclosure is not limited to such examples. It is apparent that a person having ordinary skill in the art of the disclosure can conceive of various modifications and alterations within the range of the technical ideas that are described in claims, and of course, such modifications and alterations are understood as falling within the technical scope of the disclosure.

G: Additional Note

For example, the following configurations are derivable from the aspects exemplified above.

Note that, in the present application, the term "overlap" when an element A and an element B overlap each other as viewed in a specific direction means that at least a portion of the element A and at least a portion of the element B overlap each other as viewed in the direction. It is not necessary that the entire element A and the entire element B overlap each other, and a state where at least a portion of the element A and at least a portion of the element B overlap each other is considered as that the element A and the element B "overlap" each other.

A liquid ejecting head according to an aspect (aspect 1) of the disclosure includes: a first pressure chamber that extends in a first direction and applies pressure to a liquid; a second pressure chamber that extends in the first direction and applies pressure to the liquid; a first nozzle channel that extends in the first direction and includes a first nozzle for ejecting the liquid; a first communication channel that extends in a second direction intersecting the first direction and communicates with the first pressure chamber and the first nozzle channel; and a second communication channel that extends in the second direction and communicates with the second pressure chamber and the first nozzle channel, in which a width of the first nozzle channel in the first direction is larger than a width of the first communication channel in the second direction, and a width of the first nozzle channel in a third direction intersecting the first direction and the second direction is smaller than a width of the first communication channel in the third direction. According to the aspect, it is possible to reduce structural crosstalk in the first nozzle channel while suppressing an increase in channel resistance of the first communication channel.

According to a specific example (aspect 2) of the aspect 1, the liquid ejecting head may further include: a third pressure chamber that extends in the first direction and applies pressure to the liquid; a fourth pressure chamber that extends in the first direction and applies pressure to the liquid; a second nozzle channel that extends in the first direction and includes a second nozzle for ejecting the liquid; a third communication channel that extends in the second direction and communicates with the third pressure chamber and the second nozzle channel; and a fourth communication channel that extends in the second direction and communicates with the fourth pressure chamber and the second nozzle channel, in which a width of the second nozzle channel in the first direction may be larger than a width of the third communication channel in the second direction, and a width of the second nozzle channel in the third direction may be smaller than a width of the third communication channel in the third direction. According to the aspect, it is possible to reduce structural crosstalk in the second nozzle channel while suppressing an increase in channel resistance of the second communication channel.

According to a specific example (aspect 3) of the aspect 2, the first nozzle channel and the second nozzle channel may be adjacent to each other in the third direction.

According to a specific example (aspect 4) of the aspect 3, a thickness of a partition provided between the first nozzle channel and the second nozzle channel may be greater than a thickness of a partition provided between the first communication channel and the third communication channel. According to the aspect, even when vibration is generated in one of the first nozzle channel and the second nozzle channel, the vibration is difficult to be transferred to the other nozzle channel. Accordingly, structural crosstalk between the first nozzle channel and the second nozzle channel is reduced.

According to a specific example (aspect 5) of any of the aspects 2 to 4, the liquid ejecting head may further include: a first individual supply channel which communicates with the first pressure chamber and along which the liquid is supplied to the first pressure chamber; a second individual supply channel which communicates with the third pressure chamber and along which the liquid is supplied to the third pressure chamber; a common supply channel along which the liquid is supplied in common to the first individual supply channel and the second individual supply channel; a first individual discharge channel which communicates with the second pressure chamber and along which the liquid is discharged from the second pressure chamber; a second individual discharge channel which communicates with the fourth pressure chamber and along which the liquid is discharged from the fourth pressure chamber; and a common discharge channel along which the liquid is discharged in common from the first individual discharge channel and the second individual discharge channel.

According to a specific example (aspect 6) of any of the aspects 2 to 4, the liquid ejecting head may further include: a first individual supply channel which communicates with the second pressure chamber and along which the liquid is supplied to the second pressure chamber; a second individual supply channel which communicates with the fourth pressure chamber and along which the liquid is supplied to the fourth pressure chamber; a common supply channel along which the liquid is supplied in common to the first individual supply channel and the second individual supply channel; a first individual discharge channel which communicates with the first pressure chamber and along which the liquid is discharged from the first pressure chamber; a second individual discharge channel which communicates with the third pressure chamber and along which the liquid is discharged from the third pressure chamber; and a common discharge channel along which the liquid is discharged in common from the first individual discharge channel and the second individual discharge channel.

According to a specific example (aspect 7) of any of the aspects 1 to 6, the width of the first nozzle channel in the first direction may be larger than a width of the second communication channel in the second direction, and the width of the first nozzle channel in the third direction may be smaller than a width of the second communication channel in the third direction. According to the aspect, it is possible to reduce structural crosstalk in the first nozzle channel while suppressing an increase in channel resistance of the second communication channel.

According to a specific example (aspect 8) of any of the aspects 1 to 7, the width of the first communication channel in the second direction may be larger than a width of the second communication channel in the second direction, and the width of the first communication channel in the third direction may be smaller than a width of the second communication channel in the third direction.

According to a specific example (aspect 9) of any of the aspects 1 to 8, a sectional area of the first nozzle channel as viewed in the first direction may be smaller than a sectional area of the first communication channel as viewed in the second direction.

According to a specific example (aspect 10) of any of the aspects 1 to 9, the liquid ejecting head may further include: a pressure chamber substrate at which the first pressure chamber and the second pressure chamber are formed; a first communication plate at which the first communication channel and the second communication channel are formed; and a nozzle substrate at which the first nozzle is formed.

According to a specific example (aspect 11) of the aspect 10, the first nozzle channel may be formed at the first communication plate.

According to a specific example (aspect 12) of the aspect 10, the first nozzle channel may be formed at the nozzle substrate.

According to a specific example (aspect 13) of the aspect 10, the first nozzle channel may be formed across the first communication plate and the nozzle substrate.

According to a specific example (aspect 14) of the aspect 10, the liquid ejecting head may further include a second communication plate that includes the first nozzle channel, in which the second communication plate may be provided between the first communication plate and the nozzle substrate.

According to a specific example (aspect 15) of the aspect 10, the width of the first communication channel in the second direction may differ from a width of the second communication channel in the second direction.

According to a specific example (aspect 16) of any of the aspects 1 to 15, the liquid ejecting head may further include: a first energy-generating element that, upon application of a driving voltage, generates energy for applying pressure to the liquid in the first pressure chamber; and a second energy-generating element that, upon application of a driving voltage, generates energy for applying pressure to the liquid in the second pressure chamber.

A liquid ejecting head according to an aspect (aspect 17) of the disclosure includes: a first pressure chamber that extends in a first direction and applies pressure to a liquid; a second pressure chamber that extends in the first direction and applies pressure to the liquid; a first nozzle channel that extends in the first direction and includes a first nozzle for ejecting the liquid; a first communication channel that extends in a second direction intersecting the first direction and communicates with the first pressure chamber and the first nozzle channel; and a second communication channel that extends in the second direction and communicates with the second pressure chamber and the first nozzle channel, in which a width of the first nozzle channel in the first direction is larger than a width of the first communication channel in the second direction, and a sectional area of the first nozzle channel as viewed in the first direction is smaller than a sectional area of the first communication channel as viewed in the second direction.

A liquid ejecting head according to an aspect (aspect 18) of the disclosure includes: a first pressure chamber that extends in a first direction and applies pressure to a liquid; a second pressure chamber that extends in the first direction and applies pressure to the liquid; a first nozzle channel that extends in the first direction and includes a first nozzle for ejecting the liquid; a first communication channel that extends in a second direction intersecting the first direction and communicates with the first pressure chamber and the first nozzle channel; and a second communication channel that extends in the second direction and communicates with the second pressure chamber and the first nozzle channel, in which a width of the first nozzle channel in the first direction is smaller than a width of the first communication channel in the second direction, and a width of the first nozzle channel in a third direction intersecting the first direction and the second direction is larger than a width of the first communication channel in the third direction. According to the aspect, it is possible to reduce structural crosstalk in the first communication channel while suppressing an increase in channel resistance of the first nozzle channel.

A liquid ejecting head according to an aspect (aspect 19) of the disclosure includes: a first pressure chamber that extends in a first direction and applies pressure to a liquid; a second pressure chamber that extends in the first direction and applies pressure to the liquid; a first nozzle channel that extends in the first direction and includes a first nozzle for ejecting the liquid; a first communication channel that extends in a second direction intersecting the first direction and communicates with the first pressure chamber and the first nozzle channel; and a second communication channel that extends in the second direction and communicates with the second pressure chamber and the first nozzle channel, in which a width of the first nozzle channel in the first direction is smaller than a width of the first communication channel in the second direction, and a sectional area of the first nozzle channel as viewed in the first direction is larger than a sectional area of the first communication channel as viewed in the second direction.

A liquid ejecting apparatus according to an aspect (aspect 20) of the disclosure may include: the liquid ejecting head according any one of the aspects 1 to 19; and a control section that controls ejection operation of the liquid ejecting head.

What is claimed is:

1. A liquid ejecting head comprising:

a first pressure chamber that extends in a first direction and applies pressure to a liquid;

a second pressure chamber that extends in the first direction and applies pressure to the liquid;

a first nozzle channel that extends in the first direction and includes a first nozzle for ejecting the liquid;

a first communication channel that extends in a second direction intersecting the first direction and communicates with the first pressure chamber and the first nozzle channel; and a second communication channel that extends in the second direction and communicates with the second pressure chamber and the first nozzle channel, wherein a width of the first nozzle channel in the first direction is larger than a width of the first communication channel in the second direction and a width of the first nozzle channel in a third direction intersecting the first direction and the second direction is smaller than a width of the first communication channel in the third direction.

2. The liquid ejecting head according to claim 1, further comprising:

a third pressure chamber that extends in the first direction and applies pressure to the liquid;

a fourth pressure chamber that extends in the first direction and applies pressure to the liquid;

a second nozzle channel that extends in the first direction and includes a second nozzle for ejecting the liquid;

a third communication channel that extends in the second direction and communicates with the third pressure chamber and the second nozzle channel; and a fourth communication channel that extends in the second direction and communicates with the fourth pressure chamber and the second nozzle channel, wherein a width of the second nozzle channel in the first direction is larger than a width of the third communication channel in the second direction and a width of the second nozzle channel in the third direction is smaller than a width of the third communication channel in the third direction.

3. The liquid ejecting head according to claim 2, wherein the first nozzle channel and the second nozzle channel are adjacent to each other in the third direction.

4. The liquid ejecting head according to claim 3, wherein a thickness of a partition provided between the first nozzle channel and the second nozzle channel is greater than a thickness of a partition provided between the first communication channel and the third communication channel.

5. The liquid ejecting head according to claim 2, further comprising:

a first individual supply channel which communicates with the first pressure chamber and along which the liquid is supplied to the first pressure chamber;

a second individual supply channel which communicates with the third pressure chamber and along which the liquid is supplied to the third pressure chamber;

a common supply channel along which the liquid is supplied in common to the first individual supply channel and the second individual supply channel;

a first individual discharge channel which communicates with the second pressure chamber and along which the liquid is discharged from the second pressure chamber;

a second individual discharge channel which communicates with the fourth pressure chamber and along which the liquid is discharged from the fourth pressure chamber; and a common discharge channel along which the liquid is discharged in common from the first individual discharge channel and the second individual discharge channel.

6. The liquid ejecting head according to claim 2, further comprising:

a first individual supply channel which communicates with the second pressure chamber and along which the liquid is supplied to the second pressure chamber;

a second individual supply channel which communicates with the fourth pressure chamber and along which the liquid is supplied to the fourth pressure chamber;

a common supply channel along which the liquid is supplied in common to the first individual supply channel and the second individual supply channel;

a first individual discharge channel which communicates with the first pressure chamber and along which the liquid is discharged from the first pressure chamber;

a second individual discharge channel which communicates with the third pressure chamber and along which the liquid is discharged from the third pressure chamber; and a common discharge channel along which the liquid is discharged in common from the first individual discharge channel and the second individual discharge channel.

7. The liquid ejecting head according to claim 1, wherein the width of the first nozzle channel in the first direction is larger than a width of the second communication channel in the second direction and the width of the first nozzle channel in the third direction is smaller than a width of the second communication channel in the third direction.

8. The liquid ejecting head according to claim 1, wherein the width of the first communication channel in the second direction is larger than a width of the second communication channel in the second direction and the width of the first communication channel in the third direction is smaller than a width of the second communication channel in the third direction.

9. The liquid ejecting head according to claim 1, wherein a sectional area of the first nozzle channel as viewed in the first direction is smaller than a sectional area of the second communication channel as viewed in the second direction.

10. The liquid ejecting head according to claim 1, further comprising:

a pressure chamber substrate at which the first pressure chamber and the second pressure chamber are formed;

a first communication plate at which the first communication channel and the second communication channel are formed; and a nozzle substrate at which the first nozzle is formed.

11. The liquid ejecting head according to claim 10, wherein the first nozzle channel is formed at the first communication plate.

12. The liquid ejecting head according to claim 10, wherein the first nozzle channel is formed at the nozzle substrate.

13. The liquid ejecting head according to claim 10, wherein the first nozzle channel is formed across the first communication plate and the nozzle substrate.

14. The liquid ejecting head according to claim 10, further comprising a second communication plate that includes the first nozzle channel, wherein the second communication plate is provided between the first communication plate and the nozzle substrate.

15. The liquid ejecting head according to claim 10, wherein the width of the first communication channel in the second direction differs from a width of the second communication channel in the second direction.

16. The liquid ejecting head according to claim 1, further comprising:

a first energy-generating element that, upon application of a driving voltage, generates energy for applying pressure to the liquid in the first pressure chamber; and a second energy-generating element that, upon application of a driving voltage, generates energy for applying pressure to the liquid in the second pressure chamber.

17. A liquid ejecting apparatus comprising:

the liquid ejecting head according to claim 1; and a control section that controls ejection operation of the liquid ejecting head.

18. A liquid ejecting head comprising:

a first pressure chamber that extends in a first direction and applies pressure to a liquid;

a second pressure chamber that extends in the first direction and applies pressure to the liquid;

a first nozzle channel that extends in the first direction and includes a first nozzle for ejecting the liquid;

a first communication channel that extends in a second direction intersecting the first direction and communicates with the first pressure chamber and the first nozzle channel; and a second communication channel that extends in the second direction and communicates with the second pressure chamber and the first nozzle channel, wherein a width of the first nozzle channel in the first direction is larger than a width of the first communication channel in the second direction and a sectional area of the first nozzle channel as viewed in the first direction is smaller than a sectional area of the first communication channel as viewed in the second direction.

19. A liquid ejecting head comprising:

a first pressure chamber that extends in a first direction and applies pressure to a liquid;

a second pressure chamber that extends in the first direction and applies pressure to the liquid;

a first nozzle channel that extends in the first direction and includes a first nozzle for ejecting the liquid;

a first communication channel that extends in a second direction intersecting the first direction and communicates with the first pressure chamber and the first nozzle channel; and a second communication channel that extends in the second direction and communicates with the second pressure chamber and the first nozzle channel, wherein a width of the first nozzle channel in the first direction is smaller than a width of the first communication channel in the second direction and a width of the first nozzle channel in a third direction intersecting the first direction and the second direction is larger than a width of the first communication channel in the third direction.

20. A liquid ejecting head comprising:

a first pressure chamber that extends in a first direction and applies pressure to a liquid;

a second pressure chamber that extends in the first direction and applies pressure to the liquid;

a first nozzle channel that extends in the first direction and includes a first nozzle for ejecting the liquid;

a first communication channel that extends in a second direction intersecting the first direction and communicates with the first pressure chamber and the first nozzle channel; and a second communication channel that extends in the second direction and communicates with the second pressure chamber and the first nozzle channel, wherein a width of the first nozzle channel in the first direction is smaller than a width of the first communication channel in the second direction and a sectional area of the first nozzle channel as viewed in the first direction is larger than a sectional area of the first communication channel as viewed in the second direction.

* * * * *